US006527050B1

(12) United States Patent
Sask

(10) Patent No.: US 6,527,050 B1
(45) Date of Patent: Mar. 4, 2003

(54) METHOD AND APPARATUS FOR FORMATION DAMAGE REMOVAL

(76) Inventor: David Sask, 1020 Mona Drive, Kingston, Ontario (CA), K7P 2P6

( * ) Notice: Subject to any disclaimer, the term of this patent is extended or adjusted under 35 U.S.C. 154(b) by 0 days.

(21) Appl. No.: 09/629,841

(22) Filed: Jul. 31, 2000

(51) Int. Cl.[7] ..... E21B 43/25; E21B 43/18

(52) U.S. Cl. ..... 166/299; 166/305.1; 166/147; 166/186; 166/177.7; 166/312

(58) Field of Search ..... 166/249, 299, 166/311, 312, 177.7, 222, 147, 184, 126, 127, 191, 185, 186, 305.1

(56) References Cited

U.S. PATENT DOCUMENTS

| | | | | |
|---|---|---|---|---|
| 2,859,828 A | | 11/1958 | Williams | 166/187 |
| 3,430,181 A | | 2/1969 | Urbanosky | 339/16 |
| 3,439,740 A | | 4/1969 | Conover | 166/250 |
| 3,577,782 A | | 5/1971 | Aitken | 73/155 |
| 3,687,202 A | * | 8/1972 | Young et al. | 166/126 |
| 3,782,191 A | | 1/1974 | Whitten | 73/155 |
| 3,831,443 A | | 8/1974 | Planche | 73/152 |
| 4,343,357 A | * | 8/1982 | Yeates | 166/154 |
| 4,345,648 A | | 8/1982 | Kuus | 166/106 |
| 4,393,930 A | * | 7/1983 | Ross et al. | 166/188 |
| 4,434,653 A | | 3/1984 | Montgomery | 73/151 |
| 4,535,843 A | | 8/1985 | Jageler | 166/250 |
| 4,541,481 A | | 9/1985 | Lancaster | 166/65.1 |
| 4,573,532 A | | 3/1986 | Blake | 166/264 |
| 4,619,325 A | * | 10/1986 | Zunkel | 166/319 |
| 4,658,902 A | * | 4/1987 | Wesson et al. | 166/317 |
| 4,744,420 A | | 5/1988 | Patterson et al. | 166/312 |

(List continued on next page.)

FOREIGN PATENT DOCUMENTS

| | | | |
|---|---|---|---|
| CA | 1249772 | 2/1989 | E21B/49/08 |
| CA | 1325969 | 1/1994 | E21B/37/00 |
| CA | 2167491 | 1/1997 | E21B/19/22 |

OTHER PUBLICATIONS

PCT International Application No. PCT/US97/03563, filed Mar. 5, 1997, entitled Method and Apparatus Using Coiled–in–Coiled Tubing, International Publication No. WO 97/35093, published Sep. 25, 1997.

PCT International Application No. PCT/US95/10007, filed Jul. 25, 1995, entitled Safeguarded Method and Apparatus for Fluid Communication Using Coiled Tubing, with Application to Drill Stem Testing, International Publication No. WO 97/05361, published Feb. 13, 1997.

International Application WO 00/14378, filed Sep. 6, 1999, published Mar. 16, 2000.

International Search Report of corresponding PCT/CA01/01082, dated Feb. 7, 2002.

Extreme Overbalance Perforating, Al Salsman et al., The Perforating and Testing Review, vol. 8, No. 1, 8 pages, May 1, 1995.

Ultrasonic Removal of Near Wellbore Damage Caused by Fines and Mud Solids, Adinathan Venkitaraman et al., SPE 27388, Copyright 1995 Society of Petroleum Engineers, 5 pages.

*Primary Examiner*—Hoang Dang
(74) *Attorney, Agent, or Firm*—Anthony R. Lambert

(57) ABSTRACT

A method of removing formation damage through the controlled injection of fluids into the formation, followed by a controlled sudden release of pressure in the formation, an under-balanced surge, which causes fluid and damaging materials to flow back into the well bore. This method is most effective when repeated more than once.

87 Claims, 13 Drawing Sheets

U.S. PATENT DOCUMENTS

| | | | | | |
|---|---|---|---|---|---|
| 4,793,417 | A | | 12/1988 | Rumbaugh | 166/312 |
| 4,898,236 | A | | 2/1990 | Sask | 166/65.1 |
| 4,903,775 | A | * | 2/1990 | Manke | 166/149 |
| 4,995,462 | A | | 2/1991 | Sask et al. | 166/304 |
| 5,033,545 | A | | 7/1991 | Sudol | 166/312 |
| 5,086,842 | A | | 2/1992 | Cholet | 166/312 |
| 5,205,360 | A | | 4/1993 | Price | 166/308 |
| 5,265,678 | A | | 11/1993 | Grundmann | 166/308 |
| 5,287,741 | A | | 2/1994 | Schultz et al. | 73/155 |
| 5,297,631 | A | | 3/1994 | Gipson | 166/308 |
| 5,411,105 | A | | 5/1995 | Gray | 175/69 |
| 5,482,119 | A | | 1/1996 | Manke et al. | 166/374 |
| 5,503,014 | A | | 4/1996 | Griffith | 73/155 |
| 5,638,904 | A | | 6/1997 | Misselbrook et al. | 166/384 |
| 5,669,448 | A | | 9/1997 | Minthorn et al. | 166/308 |
| 5,725,054 | A | | 3/1998 | Shayegi et al. | 166/263 |
| 5,836,393 | A | | 11/1998 | Johnson | 166/308 |
| 5,862,869 | A | | 1/1999 | Michael | 175/71 |
| 5,875,852 | A | | 3/1999 | Floyd et al. | 166/387 |
| 6,241,019 | B1 | | 6/2001 | Davidson et al. | 166/249 |
| 6,296,058 | B1 | * | 10/2001 | Brieger | 166/299 |
| 6,325,146 | B1 | * | 12/2001 | Ringgenberg et al. | 166/186 |

* cited by examiner

METHOD AND APPARATUS FOR FORMATION DAMAGE REMOVAL

FIELD OF INVENTION

This invention relates to methods and apparatus for treating underground formations to remove formation damage.

BACKGROUND OF THE INVENTION

The production of hydrocarbons from underground reservoirs is often hampered by a damaged zone in the reservoir rock around the well bore.

These damage mechanisms include:

1. Drilling damage caused by the high velocity of drilling fluids passing through the jets in the drilling bit which can force liquid and particulate matter beyond the well bore out into the reservoir pore spaces.
2. Plugging of the pore spaces in the reservoir region immediately around the drilled well bore can be caused by formation rock material from the drilling process. These drill cuttings and fines can be forced into the pore spaces of the surrounding rock by several mechanisms; the rotation of the drill string and the weight of that drill string can put very high forces on particulate matter trapped between the drill string and the face of the well bore, compacting it into the pore spaces of the formation; or the pressure of the fluid in the well bore, which is normally higher than the pressure in the surrounding reservoir, can force drilling fines beyond the compaction zone and into the surrounding pores
3. Plugging of the pore spaces around the well bore can also be the result of particulate matter added to the drilling fluids to create a filter cake around the well bore which is intended to minimize the leak off of liquids into the surrounding reservoir. The mechanisms that force this particulate matter into the pore spaces are identical to those that cause damage from drilling fines, notably pressure, force and velocity.
4. Pore space reduction can occur as a result of alteration to the reservoir materials in the region surrounding the well bore. The most well known damage of this type is caused by clays in the reservoir which absorb fluids, most often water, and swell in physical size. This swelling reduces the size of the pore spaces and often reduces the permeability to the flow of reservoir hydrocarbons. This type of damage is often very difficult to remove or alter, and usually requires a hydraulic fracture with compatible fluids to bypass the damaged zone.
5. Fluid blockage in the region around the well bore results when the naturally occurring fluids in the reservoir are replaced by fluids injected during drilling or well service operations. Drilling fluids, fresh water, salt water, acids, acid reaction products, and other chemicals that are used in well operations can result in fluid blockage. These fluids can alter the surface tension between the rock and the fluid, which can have a dramatic impact on fluid to mobility and production. Emulsions and colloidal suspensions are two specific types of fluid blockage.

The development of horizontal drilling technology has provided additional challenges with respect to formation damage. In vertical wells, it normally only takes a matter of hours to drill through a hydrocarbon bearing formation and establish a stable filter cake on the face of the well bore to prevent further damage due to migration of solids and fluids. In horizontal wells however, drilling of the producing formation can take several days or longer which means that the formation is exposed to drill cuttings, drilling fluids and pressure for a much longer period of time than a conventional vertical well. The filter cake which helps to prevent fluid loss and invasion of particulate matter into the formation is much more susceptible to being removed by the weight, rotation and axial movement of the drill pipe tool joints. This can lead to a damaged region around the well bore which is much larger in areal extent and is more severely damaged than is the case for a vertical well bore.

In practice, damage removal in producing hydrocarbon reservoirs has been achieved through the use of primarily two techniques, acidizing and hydraulic fracturing. In carbonate reservoirs, acid injection to dissolve some of the rock material has proven to be effective in many situations. It is generally only when the damage is so severe as to prevent any injection of acid into the formation, that acid does not reduce the damge and improve production.

The use of acid to remove damage in reservoirs which have an active water drive can result in very serious production problems if the acid opens up channels into the water bearing portion of the reservoir. This situation can lead to very high water production levels which may render the well uneconomic to produce.

In sandstone reservoirs, acid is much less effective in reducing damage, particularly if the damaged region around the well bore is relatively deep or if the damage is severe. It is common practice in sandstone reservoirs to use hydraulic fracturing to create a fracture in the formation which extends beyond the region of damage and provides a flow channel from the undamaged formation to the well bore.

Virtually all well stimulation methods are based upon providing a pressure surge in the well bore or in the formation. One of the first methods utilized for oil well stimulation involved dropping containers of nitroglycerin down wells, which caused a high pressure surge when the nitro-glycerin exploded. Even acidizing and fracturing operations on wells can be classified as surge techniques since they employ the use of positive pressure across the well bore to formation interface. Numerous other surge techniques have been developed over the years including, underbalanced perforating systems, overbalanced explosive "Stress-Frac" type systems, drop bar surge completion techniques, and more recently, extreme overbalanced perforating systems.

Some of these techniques use a long pressure cycle and some of them use an extremely short pressure cycle of less than a second. They generally use either a positive or a negative pressure differential across the well bore to formation interface, but not both. The pressure surge initiation can be either at surface or down hole in close proximity to the formation face. These techniques can involve the injection of solids (fracturing), liquids (acidizing) or gases (perforating) across the well bore formation interface.

It is common in the industry during stimulation operations that involve pumping fluid into the formation, to use a tubing string to convey the treating fluids to the well bore adjacent to the formation. This provides more control over displacement of the fluids, allows higher treating pressures and allows packers and other down hole flow control devices to be utilized. The tubing can be either jointed tubing or continuous coiled tubing.

It is also common in the industry to utilize sealing elements such as packers to isolate a segment of the well bore which can be "selectively" stimulated, without stimulating the remainder of the well bore. A single sealing element can be used to divide the well bore into two regions, the first region being below the sealing element and the second region being above the sealing element. Two sealing elements can be utilized to isolate a smaller region of the well bore from the regions below the lower packer and above the upper packer. Down hole devices such as fluid control valves, circulating valves and packer inflation valves which function either by mechanical or hydraulic means are well known in the industry.

In horizontal wells with long open hole sections of up to several thousands of feet, it can be appreciated that without selective stimulation tools, all treating fluids will follow the path of least resistance or least formation damage. As a result, it is possible for all of the stimulation fluids to enter the formation at the same point, and that no stimulation of the remaining formation will occur. Both gross stimulation techniques and selective stimulation techniques for treatment of horizontal wells are commonly practised.

U.S. Pat. No. 4,898,236 and Canadian patent No. 1,249,772 to Sask discloses a drill stem testing system which includes inflatable packers to isolate well bore regions for evaluation. Sask also discloses electrically operable valves for allowing fluids to flow between the various regions within and surrounding the down hole drill stem testing apparatus. However, it should be noted that Sask discloses the use of two position electrically operable valves which are biassed to one position, which necessitates the use of multiple electrically operable valves to accomplish the tasks required for drill stem testing operations.

Sask also discloses the use of an electrically operable pump for withdrawing fluids from the well bore and providing those fluids under pressure to expand inflatable type packers.

In a long horizontal well bore there is often a significant amount of particulate matter which in a vertical well would fall to the bottom of the well bore. Any packer inflation means utilizing well bore fluids for expanding packers in a horizontal well has the inherent risk of plugging either the pump or the packers with well bore particulate materials, particularly where the packers must be expanded a number of times to selectively evaluate or stimulate discreet segments of the well bore.

SUMMARY OF THE INVENTION

The present invention differs from what is taught in the prior art, in that in one aspect of the invention it teaches a method of removing formation damage through the controlled injection of fluids into the formation, followed by a controlled sudden release of pressure in the formation, an under-balanced surge, which causes fluid and damaging materials to flow back into the well bore. This method is most effective when repeated more than once. Its effectiveness in the removal of formation damage and subsequent improvement in fluid production is due to one or more of the following factors.

1. A method of removal of the solid, liquid or multi-phase materials causing the damage in the formation is preferable to and more effective than a method of simply dispersing this damaging material further into the formation. Creating a positive pressure surge into the formation tends to force materials deeper into the formation, whereas creating a negative pressure surge from the formation to the well bore tends to remove materials into the well bore. It is therefore better to utilize a negative pressure differential from the formation to the well bore to obtain the best stimulation results.
2. The ability to control the surge at the formation face, rather than at the surface, is preferred since it allows for more instantaneous release of the pressure, resulting in higher velocities in the near well bore region where the formation damage exists.
3. The use of nitrogen or other gas as a stimulation fluid provides deeper penetration into the formation as a result of the ability of gas to penetrate smaller pore space and openings within the formation.
4. The expansion and low density of gases can be used to create significantly higher fluid velocities in the area surrounding the well bore, when the pressure on the formation is released during the surge cycle, than can be achieved with liquid treatments. This gas expansion also means that the higher velocity will be maintained for a longer time duration than if liquid is injected. The lower density of gas, the ability to vent gas flowing into the well bore at surface, and the lack of a hydrostatic pressure buildup, means that a higher pressure differential can be maintained between the well bore and the formation.
5. If one surge can improve productivity through damage removal, then repeated surges should provide even more thorough damage removal. It is highly unlikely that all formation damage will be removed through a singular surge.
6. The use of gas can be effective in fluid blockage or where emulsions have formed because the gas molecules are smaller and can diffuse into the liquids. When the pressure is released, the gas molecules will expand and will force some of the liquid to move from the formation into the well bore along with the gas. Repeated surges can result in significant liquid blockage removal.

For the reasons stated above, a preferred embodiment of the present invention utilizes gas as a stimulation fluid. However, liquids or multiple phase fluids can also be utilized with the method of this invention.

In a further aspect of the invention, in order to provide multiple surge capability using gas, and to be able to inject the gas and then very quickly surge it back into the well bore, two fluid channels are provided. One fluid channel is used for injection of fluids into the reservoir and a second is used for removal of fluids and solids from the formation. Prior art stimulation practices were prevented or severely limited from providing this capability since injection and removal had to take place in the same flow path.

In a further aspect of the invention, a down hole valve or series of valves is provided to control the flow of fluid from the injection fluid channel into the formation and from the formation back into the return fluid channel.

Although it is possible to inject fluids using prior art technology and it is possible to surge a well once using under-balanced perforating or rupture disk techniques, the ability to surge a well effectively more than once with a single flow channel can not be accomplished for several reasons.

The first limitation is that in order to flow the well back, the pressure must be released from the tubular string. If liquid has been injected, the pressure which has been applied at surface can be released very quickly since liquid is relatively incompressible, and the pressure down hole will decrease by the same amount that the surface pressure decreases. However, the pressure at the lower end of the tubing, which is still being applied against the formation, will be equal to the hydrostatic pressure of the liquid column in the tubular string. In most instances, this hydrostatic pressure will be greater than the reservoir pressure and the resulting surge will be minimal and relatively ineffective.

If gas has been injected into the formation, then as the pressure is released at surface, the expansion of the gas in the tubing will set up a pressure gradient along the tubing as virtually all of the gas injected into the tubing will flow back out of the tubing. Therefore it will take a long time for the pressure at the down hole end of the tubing to decline and this decline will be very gradual. The result will be a low fluid velocity in the formation and the lack of any effective "surge" to force damaging materials from the formation into the well bore.

If a valve is placed down hole and closed after the injection has stopped, the gas pressure in the formation can be better maintained while the tubing pressure is bled off and will provide the ability to surge the formation when the valve is opened. However, a significant amount of the injection pressure may be dissipated into the formation during the lengthy time period required to bleed down the tubing pressure.

The release of pressure from the tubing and re-pressurization for another injection cycle requires significant time, particularly if gas is utilized. This is operationally more complex than the method of the present invention and increases the costs of the treatment, especially as a result of substantially higher gas volumes required.

It can be appreciated from the preceding discussion that the use of a down hole fluid control valve to control the injection of fluids into the formation and to control the release of fluids from the formation would have a beneficial impact on the development of a surge stimulation method.

For the preceding reasons, it should also be appreciated that a surge technique will be more effective if a second fluid channel exists in which the pressure can be released back to surface. There are several options that provide the ability to achieve a dual flow configuration.

1. Two strings of jointed tubing, run side by side, can be utilized. The fluid control valve(s) allow injection down one string and flow back up the other string.
2. Concentric string tubing comprised of coiled tubing inside of jointed can be used The fluid control valve(s) allow injection down the outer string and flow back up the inner string.
3. Concentric string tubing with coiled tubing inside of coiled tubing can be used. The fluid control valve(s) allow injection down the outer string and flow back up the inner string.
4. A single string of tubing can be utilized in conjunction with the well bore annulus. This requires that the well bore annulus be essentially empty of liquid, or with a low fluid level. The stimulation apparatus disclosed in the present invention provides this configuration.

In a further aspect of the invention, there is disclosed a novel downhole valve system, in which a series of ports are selectively coupled together to allow flow of fluids through the valve system. The use of clean fluids supplied down a tubing string also provides a distinctive advantage in reducing the risk of plugging the inflation system.

In an aspect of the valve system invention, there is proposed the use of a micro-controller and an electrically driven valve. These features have distinct advantages over mechanically or hydraulically controlled valves. For a preferred embodiment of the method being disclosed in this patent, four mechanical or hydraulic valves would be required for complete operation. In order to control these valves individually would require very complex mechanical or hydraulic operations. Mechanically, only tension or compression can be utilized since it is not possible to rotate coiled tubing. In a well with a long horizontal section, the ability to precisely apply tension or compression for manipulating a valve can be difficult if not impossible due to severe friction between the coiled tubing and the well bore.

The use of hydraulic pressure for sequencing four distinct valves would require a complex array of pressure settings and could severely limit the flexibility of the treatment procedure as compared to the singular multiple position fluid control valve disclosed in this patent. In one aspect of the method of the invention, the surge stimulation method uses a short injection cycle followed by the immediate release of pressure. The use of a multiple position fluid control valve has a level of simplicity in design which will effect reliability of the stimulation tool in a very positive manner.

In another aspect of the invention, a wireline conductor between the surface computer and the down hole apparatus allows both power and control commands to be sent from surface to the down hole apparatus. Data measurements in the down hole apparatus, such as pressure and temperature, can be sent back to the surface computer. The importance of real time data in drill stem testing operations is discussed in the Sask patent.

In a further aspect of the invention, there is provided a method for stimulating the production of fluids from subsurface regions surrounding a well bore. This method relates to the technique of injecting and removing stimulation fluids from the formation in a controlled surging method.

In one aspect of the invention, fluids are injected at pressures higher than the formation pressure in order to create a zone around the well bore of higher pressure than what is in the formation. This injection period to create a positive surge, will be for a relatively short period of time, normally in the order of minutes. The injection period may or may not be followed by a brief transition time to allow the injected fluid to mix with and associate with the formation fluids or formation materials. The pressure in the formation is then released to a conduit in the well bore which creates a negative surge and allows the pressure to fall back to or less than the native formation pressure. This surge process can be repeated any number of cycles to facilitate more complete removal of the formation damage around the well bore.

In a further aspect of the invention, there is provided a method for evaluating the permeability and formation damage in the porous rock around a well bore. This method relates to the use of a single string coiled tubing and a down hole assembly which includes a microcontroller, an electrically operable fluid control valve and electrically operable pressure sensing devices which allow for real time pressure transient analysis techniques before, during and after formation stimulation treatments.

In another aspect of the invention, a down hole evaluation and stimulation system is provided which allows these methods to be performed in a well. The down hole tool is lowered into the well at the end of a string of segmented tubing or continuous coiled tubing. In one aspect of the invention, the tool comprises of a number of elongated housings which direct fluid between the various regions around the down hole tool. An inventive aspect of the tool is a valve arrangement which directs flow between the various separate regions This valve arrangement allows for the injection of high pressure fluids down a conduit from surface into the subsurface reservoir. The arrangement also allows the flow of injected fluids to be stopped at the down hole tool without bleeding back the pressure in the conduit. The valve arrangement is capable of releasing the pressure in the subsurface formation back to a second conduit which is also connected to the surface.

These and other aspects of the invention are described in the detailed description and claimed in the claims that follow the detailed description.

BRIEF DESCRIPTION OF THE DRAWINGS

There will now be described preferred embodiments of the invention, with reference to the drawings by way of illustration only, in which like reference characters denote like elements and in which:

FIGS. 7, 7A and 7B are schematic showing the electronics for a downhole tool according to the invention, with FIG. 7 showing the relationship between FIGS. 7A and 7B.

DESCRIPTION OF PREFERRED EMBODIMENTS OF THE INVENTION

This description is of preferred embodiments and is intended merely to be illustrative and not limiting of the claims. The word comprising as used in the description and claims means "including" and not "consisting". Where an element is referred to in the claims as "a" or "an" element, then that does not exclude the possibility that more than one of those elements exists. Where an element is referred to as being "necessary" or "required" that is a reference to that particular aspect of the invention and not necessarily to all aspects of the invention.

Figure 1:
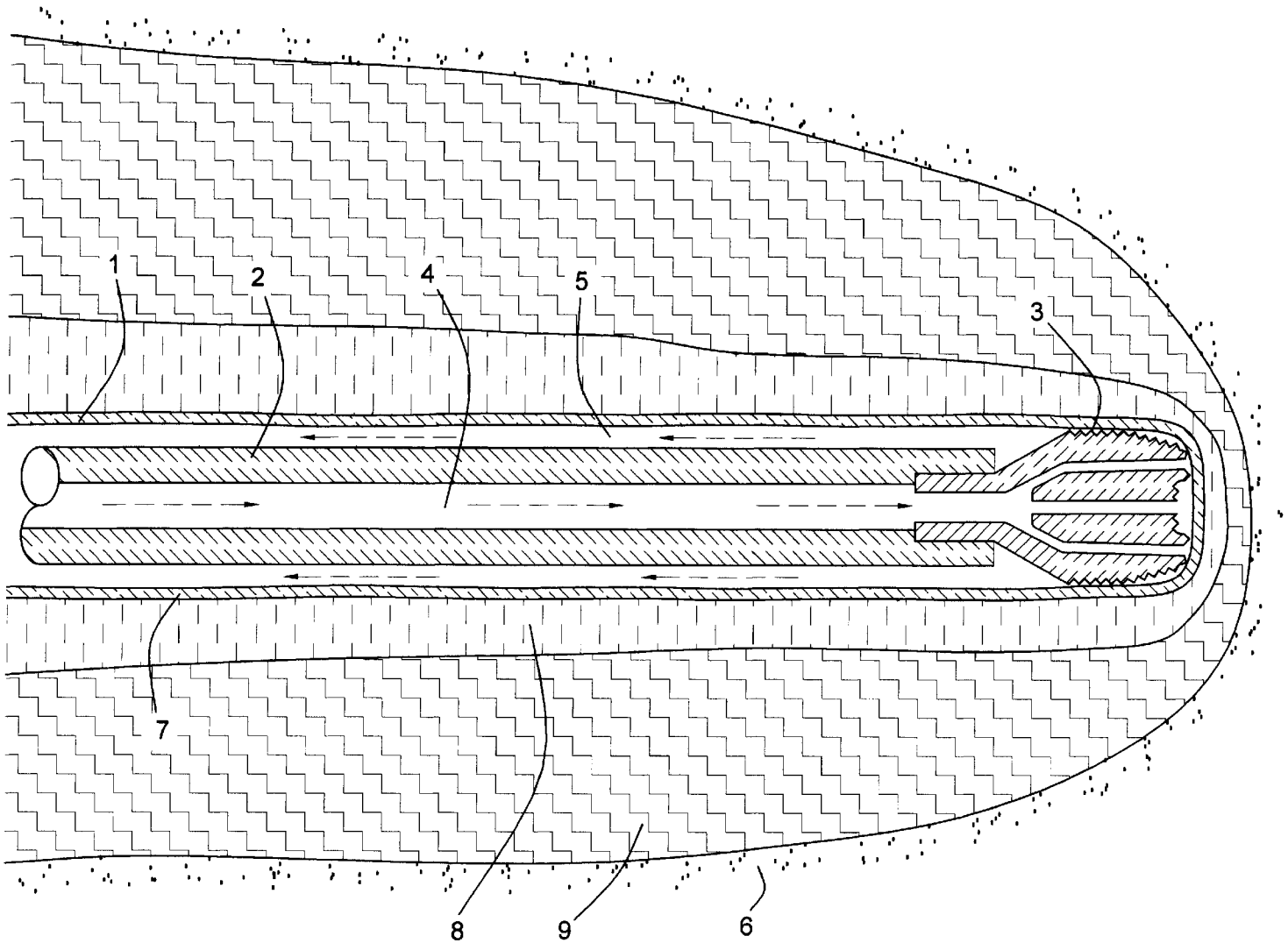
FIG. 1 is a section showing a typical well bore region during the drilling process, and shows three major types of formation damage induced by the drilling process.

Formation damage, or blockage of the pore spaces in the region around a well bore, can result in reduced production of fluids from the reservoir. FIG. 1 shows the three primary types of formation damage created during the well drilling process; a compaction zone, a zone of solids invasion, and a larger zone of fluid invasion.

During the drilling process, drilling fluid 4 is pumped under pressure down the drill string which can include one or more drill collars 2 and through the drilling assembly including a drill bit 3. The drill bit has teeth which grind the rock materials of the formation into pieces.

The size of the rock cuttings can vary from as large as an inch across, to very small crushed particles. With forces of several thousands of pounds being applied to the drill bit, as well as very high torque at the drill bit, the drill cuttings can become very compacted at the face of the well bore and forced into the pore spaces of the formation 7.

The velocity and pressure of the drilling fluids passing through the nozzles of the drill bit can also force the small formation solids, as well as particulate matter in the drilling fluid itself, out further into the formation 8 from the well bore. The major purpose of the drilling fluids is to carry the drill cuttings up the well bore annular area 5 to surface. When the pressure of the drilling fluid in the well bore is greater than the formation pressure, liquid from the drilling fluid will tend to leak off into a fluid invaded zone 9 surrounding the well bore. If the drilling fluid has high fluid loss characteristics, this invaded zone can be very large, extending hundreds of feet in diameter from the well bore.

Formation damage can be evaluated, reduced and removed from the area around a well bore through the methods and apparatus of the present invention. The stimulation description details how the method and apparatus are employed to improve the well performance, and the evaluation description details how the apparatus can improve the understanding of well performance before, during and after a stimulation treatment.

Stimulation Treatment Method and Apparatus

The following description of the present invention will first disclose one embodiment of an apparatus for removing formation damage and increasing the rate of fluid flow from the formation into the well bore. An inventive method for removing the formation damage from the area around the well bore using this or other similar apparatus will then be disclosed.

Figure 2:
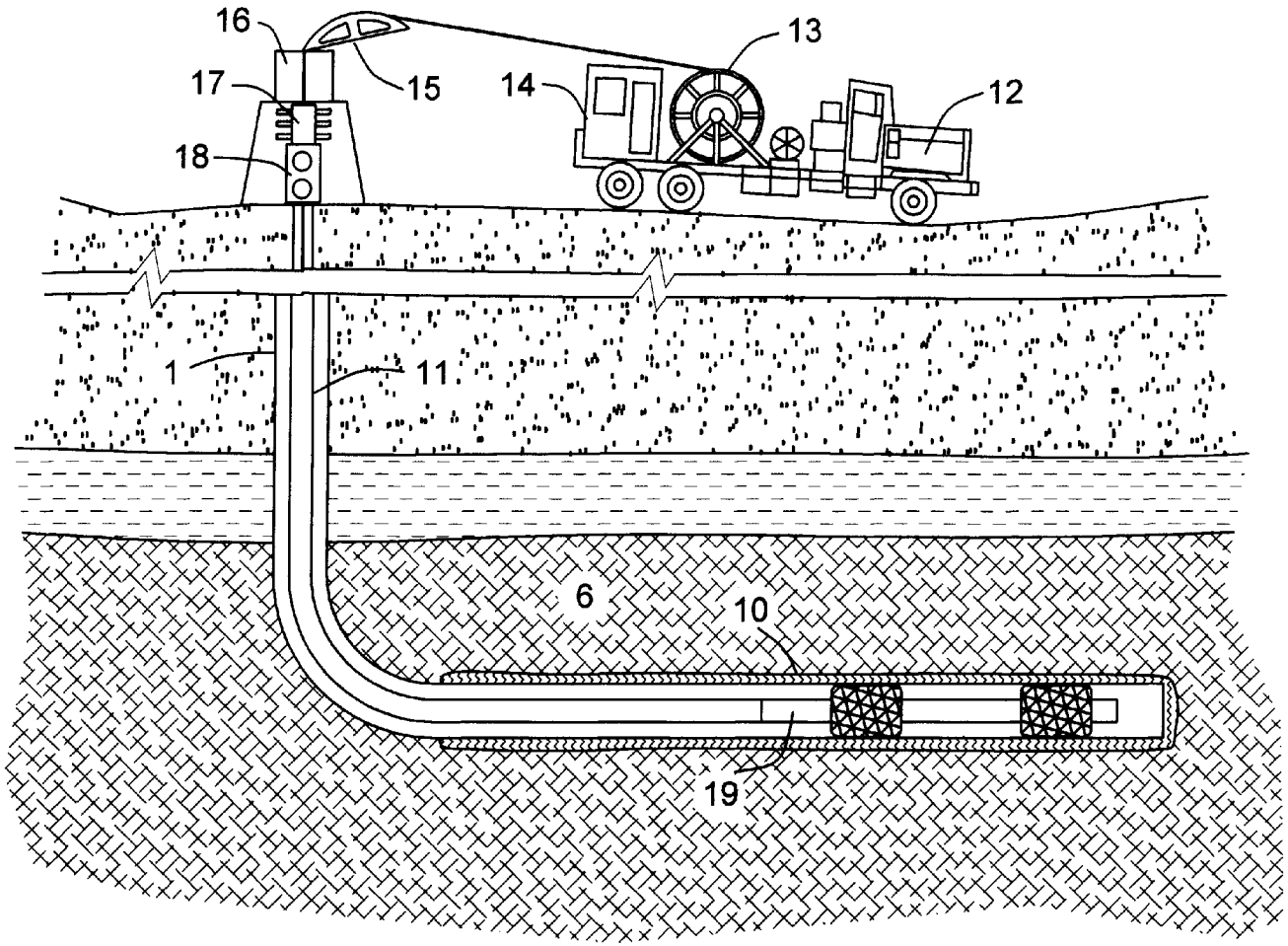
FIG. 2 is partly in section (below ground), and partly a schematic side view (above ground), shows one embodiment of the present invention and the delivery system for placing the down hole stimulation tool into the horizontal well bore. The tool is delivered into the well at the end of a string of coiled tubing, which is a typical coiled tubing string with conducting wireline inside of the tubing.

FIG. 2 is one embodiment of the present invention and schematically shows a formation stimulation tool 19 positioned within a hydrocarbon bearing subsurface reservoir 6, which has a damaged region 10 around the well bore 1. The well bore has been drilled vertically from a surface well location to a depth of several thousand feet and then drilled direction ally until a horizontal well profile has been attained. The well has then been drilled horizontally for a distance of several thousand feet. The well bore may be cased to the start of the horizontal section, or in some instances, it may be cased in its entirety. The stimulation tool has been attached to the end of a elongated string of coiled tubing 11 and lowered into the well bore.

The equipment utilized at the well surface is well known in the industry. The coiled tubing is spooled from a reel 13 which is mounted on a truck 12. The tubing passes over a goose-neck 15, and through a tubing injector 16, a blowout preventor stack 17 and the wellhead 18. A lubricator stack can be added to this arrangement for pressure deployment of the tools and tubing in a live well environment. The controls for the coiled tubing unit are contained in the recorder cab 14, along with recording and control equipment for the formation stimulation tool.

The methods of deploying or inserting the stimulation tool into the well bore at surface are known in the industry. If the well bore is filled with liquid and does not flow when open at surface, it is in an over-balance condition, and normal deployment will be used. This involves lowering the tool into the well bore until just the top end remains above the blow out preventors and is held in that position with tool slips. The coiled tubing is then lowered until it engages and is locked into the connector at the top of the tool. The slips are removed from around the tool and it is lowered and the coiled tubing injector is lowered and connected to the top of the blow out preventor stack. The coiled tubing and tool can then be lowered into the well to the desired depth.

In the event that the well bore is under-balanced or void of liquid, the tool must be deployed using industry known pressure deployment techniques to prevent potentially dangerous formation fluids from escaping from the well bore while the stimulation tool and tubing are being inserted into the well bore.

Figure 3:
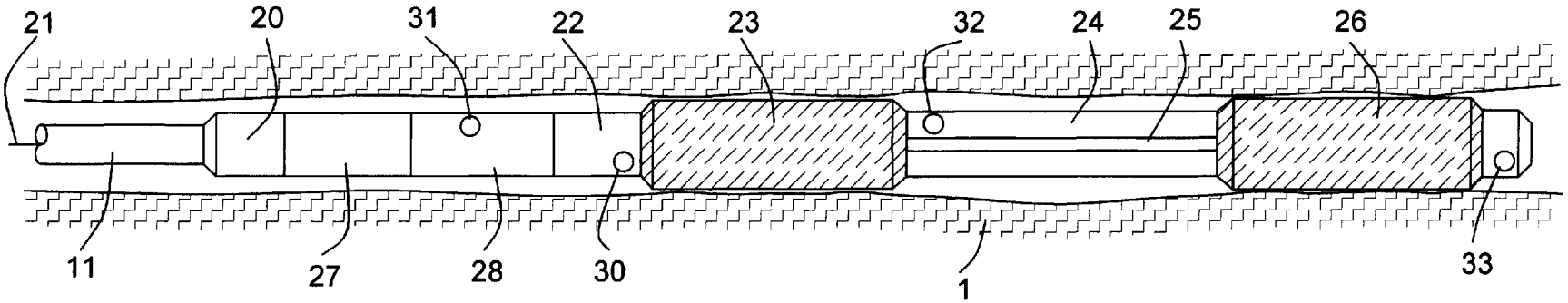
FIG. 3 is a section showing an exemplary down hole stimulation tool according to the invention.

FIG. 3 shows the major components of the stimulation tool. The tool is attached to the end of the coiled tubing 11 and to the conducting wireline 21 which is inside of the coiled tubing by a connector section 20. The electronics section 27 provides components that allow the pressure and temperature in the down hole tool and surrounding well bore regions to be recorded. This recorded data is transmitted via the wireline 21 to the operators computer in the coiled tubing truck recorder cab, where it can be viewed, graphed and analysed. The electronics section also provides components for operating the multi-position fluid control valve 28. The operations computer is shown in FIG. 7, and it may be a general purpose computer programmed in accordance with the description of the invention disclosed here. The programming of the computer is a matter well within the skill of a computer engineer in the oil industry based on the present disclosure.

The tool is shown in a dual packer embodiment, which allows a discreet segment of the well bore to be evaluated or stimulated, independent from the remainder of the well bore. The tool can also be configured with a single packer, which allows all of the well bore below the packer to be treated. In addition, it is contemplated that more than two packers could be placed in the tool string allowing more than one discreet segment to be treated simultaneously or independently. The packers 23 and 26 are inflatable type packers manufactured by any one of a number of packer manufacturers. These inflatable packers are expanded by applying pressure internally to expand the rubber element until it contacts the well bore. Other types of packers could also be used in specific well circumstances, such as when the well has been cased, or a liner has been installed in the well.

The size of the well bore segment to be treated is variable, depending upon the length of spacer 24 placed between the packers. The spacer pipe contains an internal bypass pipe 25 which allows fluid communication between the sections of the well bore above and below the packers, through ports 30 and 33 in the tool, and prevents pressure differential and any resulting axial forces from being applied to the packers.

A release tool 22 is included in the stimulation tool in order to allow the tool to be separated in the event that the packers 23, 26 become lodged in the well bore by solids or other debris. Releasing the tool above the packers 23, 26 allows the tubing 11 and upper portion of the tool to be retrieved from the well, after which the packers 23, 26 can be retrieved with circulating and fishing tools.

Figure 4C:
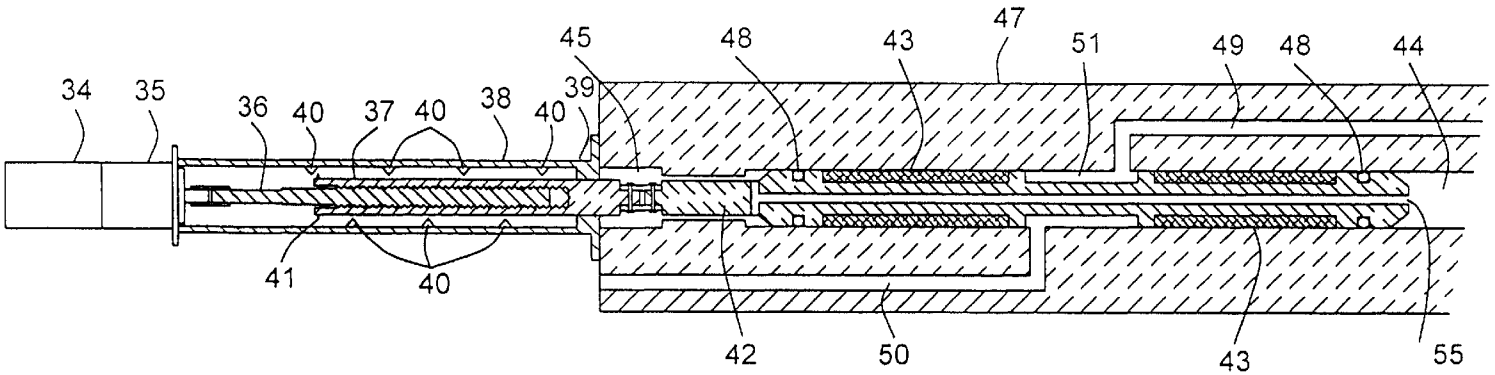
FIGS. 4*a*, 4*b* and 4*c* are respectively cross sectional views of a fluid control valve according to the invention, including the electrical board and valve system (FIG. 4*a*), pressure sensors in a section perpendicular to the section of FIG. 4*a* (FIG. 4*b*) and the valve system itself (FIG. 4*c*).
Figure 4B:
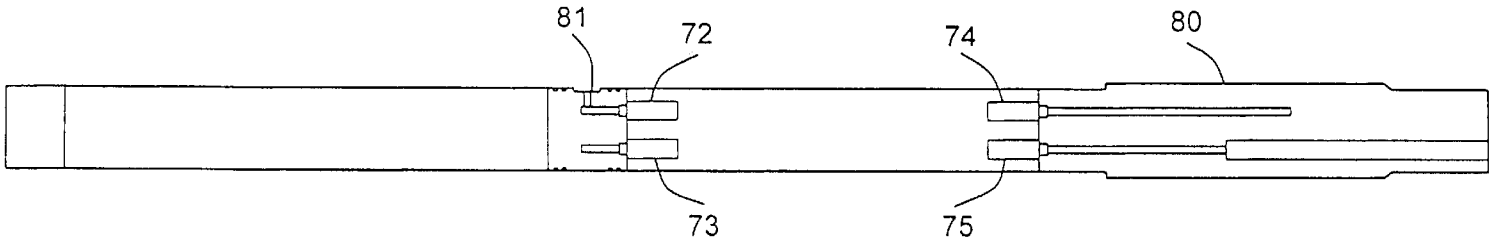
Figure 4A:
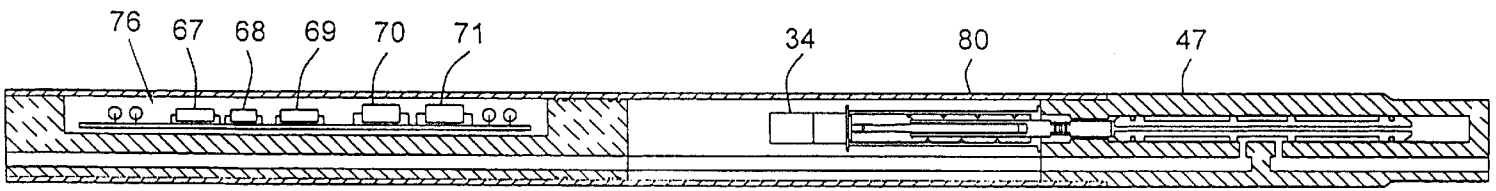

One inventive feature of the present disclosure is the fluid control valve 28. The fluid control valve in combination with a dual flow path configuration in the well bore have been found to provide most effective surge stimulation. FIGS. 4*a*, 4*b* and 4*c* show several sectional views of the fluid control valve. The valve is contained within a valve bore 44 in the valve housing 47, which has a number of fluid passages within it, two of which are shown as 49 and 50.

The valve 28 is operated from surface by computer control in the system software. The computer operator selects the desired position for the valve 28, and the computer issues the necessary software commands to carry out the necessary action. The command is sent through a communications module such as a modem (not shown, but is conventional) down the wireline to a second receiving modem 68 in the down hole electronics circuit boards 76 which conveys the command to the micro-controller 67. The modem 68 is a commercially available device. The micro-controller 67, also readily commercially available, but programmed in accordance with the patent description, determines which direction the actuator motor 34 must rotate, and turns on a switching device 71 which supplies power in the appropriate polarity from the power supply 70 to the actuator motor 34. The motor 34 is coupled to a rotating shaft 36 which is threaded externally and which rotates inside of a threaded non-rotating linear shaft 37. The non-rotating shaft 37 is held in place by the actuator housing 38, which allows linear motion but prevents the shaft 37 from rotating.

A contact 41 is mounted on the linear shaft 37, and provides contact with a series of limit switches 40 which are mounted along the actuator housing 47. These switches 40 are electronically connected to the micro-controller 67 and provide feedback to the micro-controller 67 regarding the position of the contact. The micro-controller 67 will recognize when the contact reaches the desired switch 40, indicating that the valve 28 is in the correct position, and will switch off the power to the motor 34.

The linear shaft 37 is coupled to a valve sleeve 42 which is sealed to the housing 47 by seals 43 and 48 and an area of reduced diameter 51 which allows fluid to flow between any two adjacent ports in the valve bore which are connected to fluid channels such as 49 and 50. There are five ports, in the valve bore which provide fluid channels to four regions corresponding to the packers, tubing, formation and annulus, within the down hole tool and well bore region. As can be seen from the number of limit switches 40 in FIG. 4, there are seven distinct positions at which the actuator 34 and valve spool 42 can be stopped. Four of these positions allow flow between any two adjacent ports, and the remaining three positions are closed positions which do not allow flow between any ports.

The valve spool 42 has a hole through the centre of it 55, which equalizes the pressure at each end of the spool and prevents the spool from becoming pressure locked as it is extended or contracted.

The down hole tool contains four electrical pressure transducers or pressure sensors 72–75 which measure the pressure in four separate regions of the tool and well bore. The sensors 72–75 are distributed around the tool at the same approximate level as the actuator 34. As shown in FIGS. 4*a* and 4*b*, the tool housing 80 is shown in cross-section, with the cross-section of FIG. 4*a* perpendicular to the cross-section 4*b*. Sensor 72 senses the outside pressure in the well bore through port 81 in the housing 80. Sensor 73 senses tubing pressure in channel 50 leading to the tubing 11. Sensor 74 senses inflation pressure in the packers 23, 26 through channels 49 and 54. Sensor 75 senses formation pressure through channel 52. These sensors 72, 73, 74 and 75 provide an electrical output which is connected to a signal processor 69 and the microprocessor 67. The pressure sensors 72–75 are conventional sensors that may or may not have temperature sensors integrated into the pressure sensor body. The microprocessor 67 sends the pressure information, temperature information and contact switch position information through the receiving modem 68 back to the computer at the surface of the well.

Figure 5A:
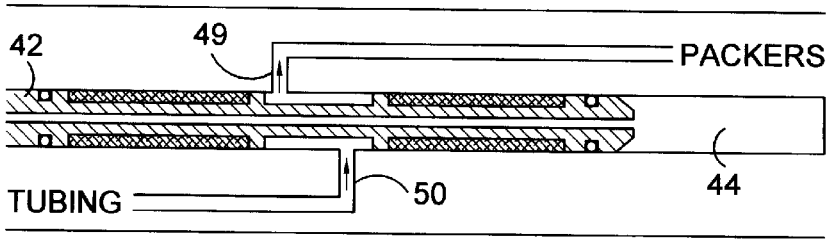
FIGS. 5*a*–5*e* are schematics showing a fluid control valve according to the invention in five differing positions and show the fluid passage ways which connect to the valve in each of these various positions.
Figure 5B:
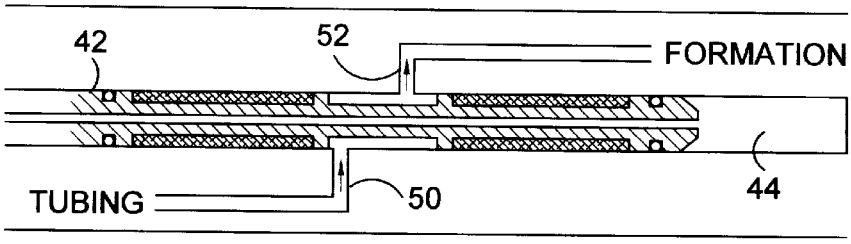
Figure 5C:
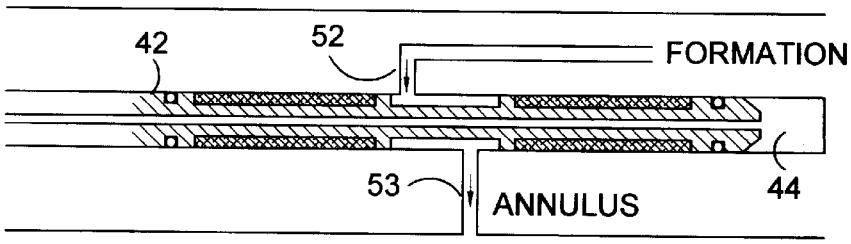
Figure 5D:
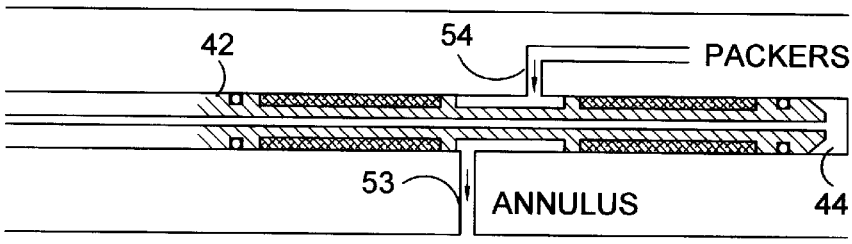
Figure 5E:
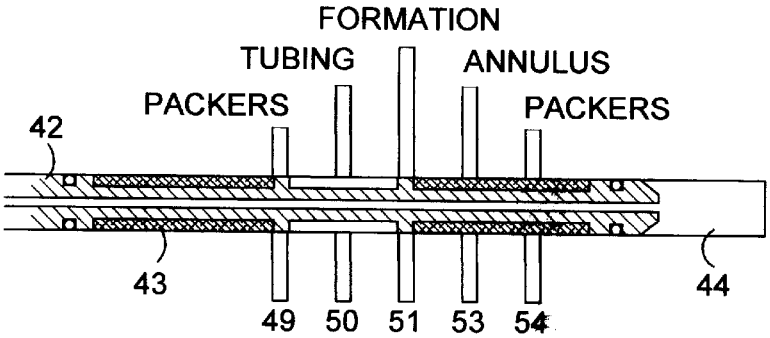
Figure 5F:
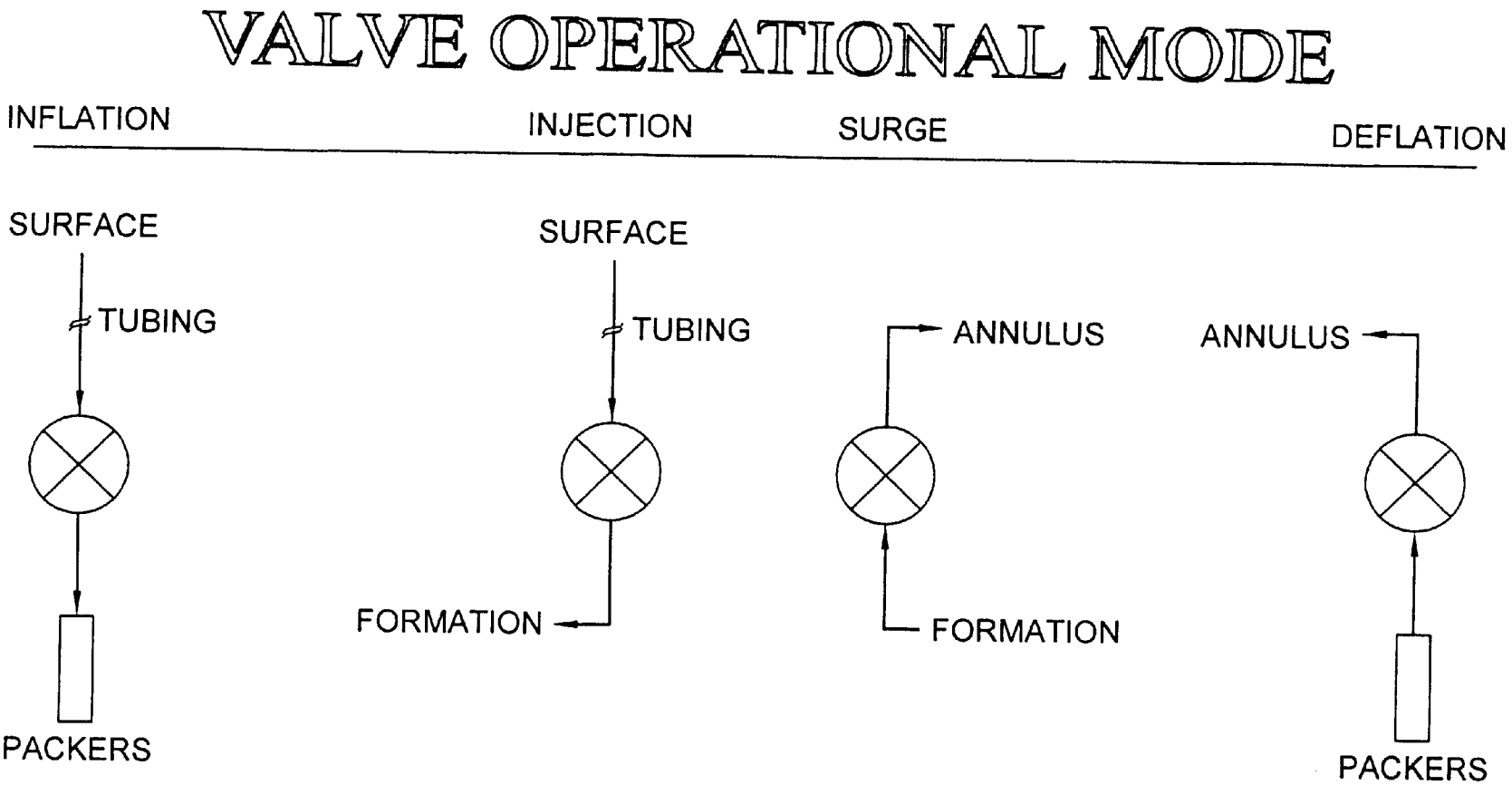
FIG. 5*f* shows a schematic representation of the flow paths through the fluid control valve.

The control of fluid through the stimulation tool from the various regions of the well bore and tool around the valve can be more fully understood with FIGS. 5*a*–5*e*. FIG. 5*a* shows the valve 28 in the inflation position with fluid flowing from the tubing 11, through flow channel 50 into the valve bore 44 and then out through fluid channel 49 to the packers 23, 26. FIG. 5*b* shows the valve in the injection position with fluid flowing from the tubing 11, through flow channel 50 into the valve bore 44 and then out through fluid channel 52 to the well bore area between the packers and into the formation. FIG. 5*c* shows the valve 28 in the surge position with fluid flowing from the formation into the well bore and through flow channel 52 into the valve bore 44 and then out through fluid channel 53 into the well bore above the packer 23. FIG. 5*d* shows the valve 28 in the deflation position with fluid flowing from the packers 23, 26, through flow channel 49 into the valve bore 44 and then out through fluid channel 53 into the well bore above the packers 26. FIG. 5*e* shows the valve in the closed position with the seals covering all ports except the port to flow channel 50.

Figure 6:
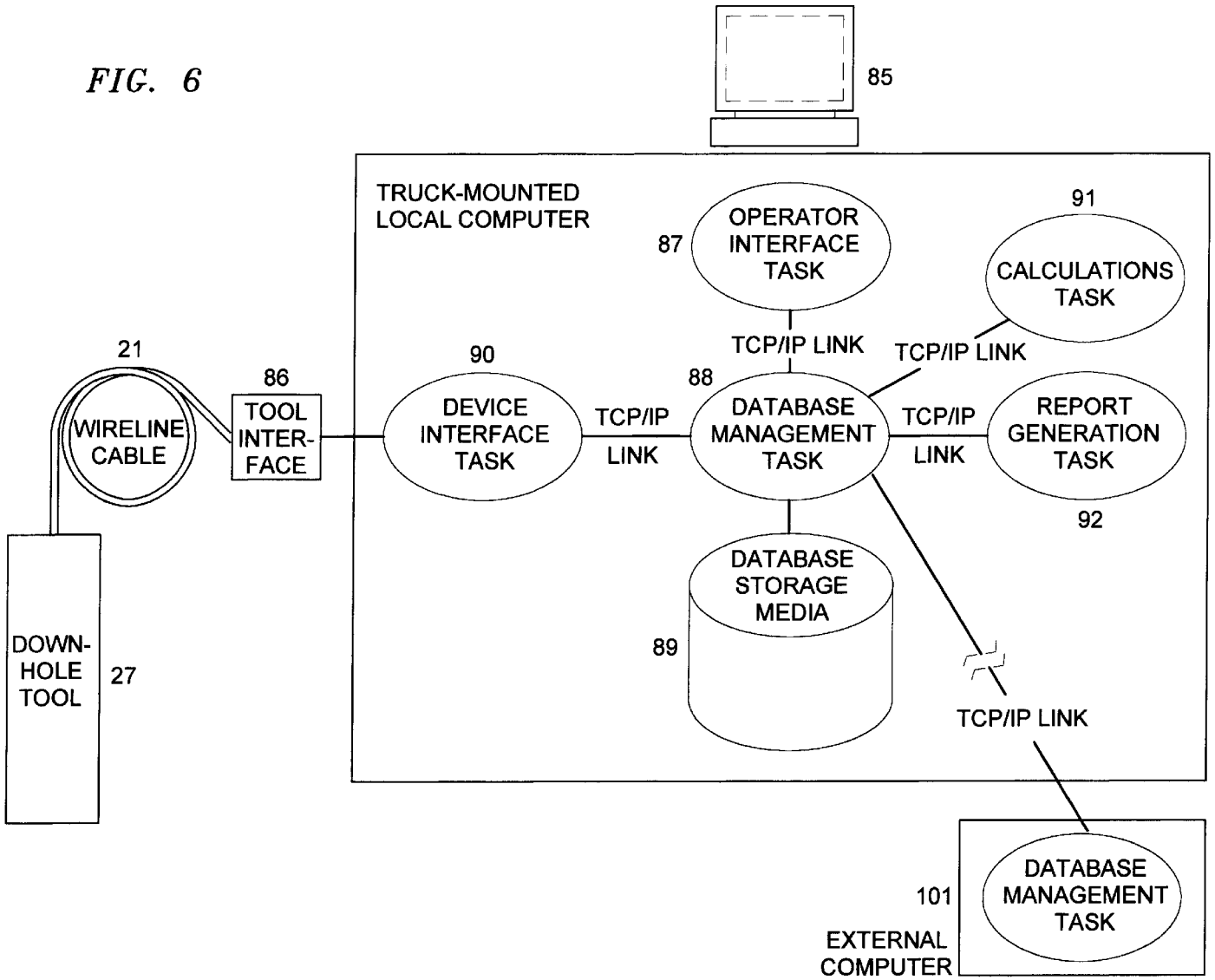
FIG. 6 is a schematic showing a software architecture overview for the control of a downhole stimulation tool according to the invention.

The computer control and data acquisition system can be more fully understood with FIG. 6 and FIG. 7. The software architecture as shown in FIG. 6 utilizes a standard commercially available desktop style or notebook style computer 85 which is linked to a tool interface 86 and then to the down hole tool electronics section 27 through the wireline cable 21. The computer 85 runs commercially available software which has been programmed to include an operator interface task 87 which is linked to a date management task 88, a database storage medium 89, a device interface task 90, a calculation task 91 and a report generation task 92. An external computer 101 with software and database management task software, located remotely from the well operations, can be connected to allow personnel not at the well site to observe the data.

Figure 7A:
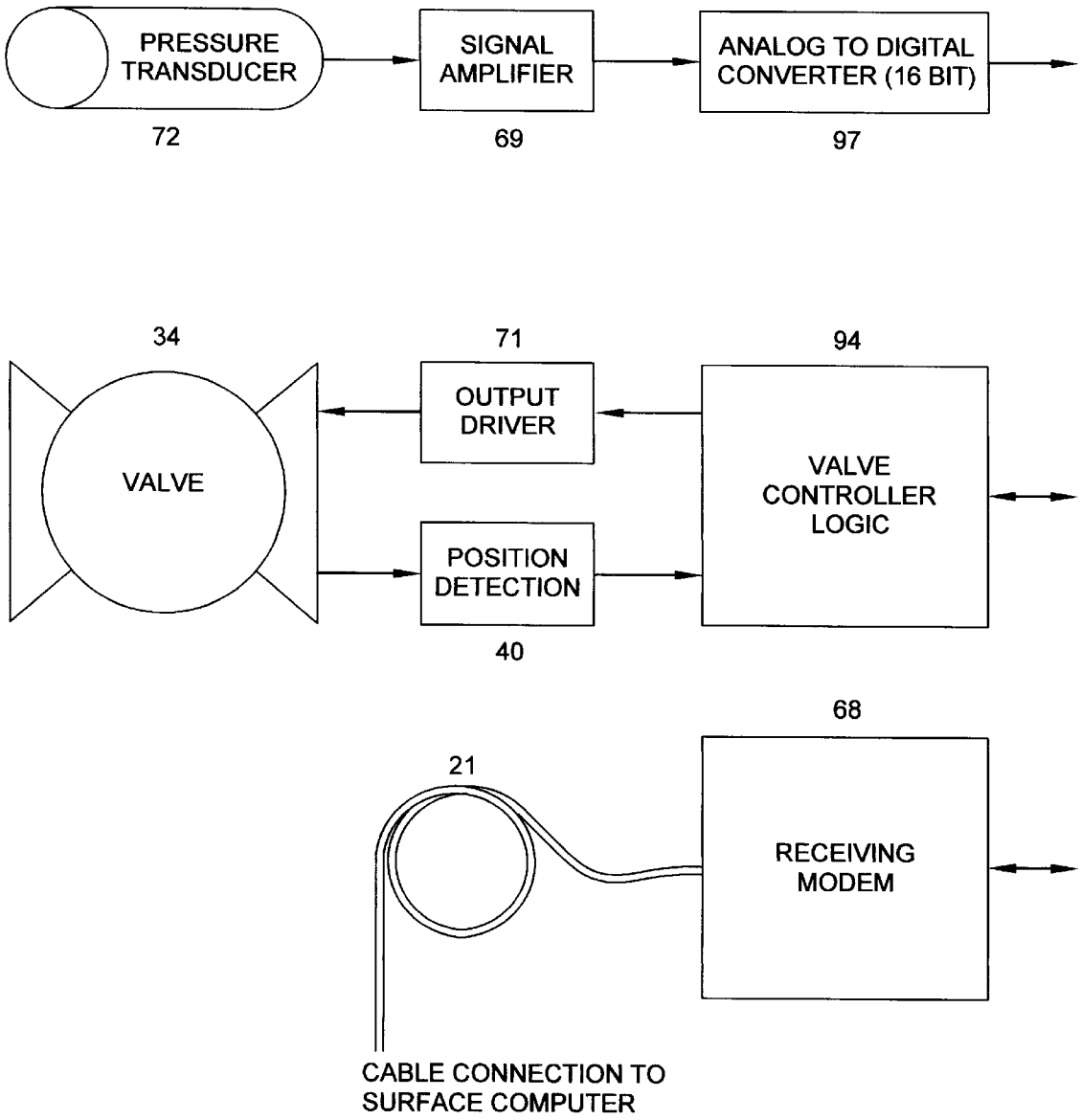
Figure 7B:
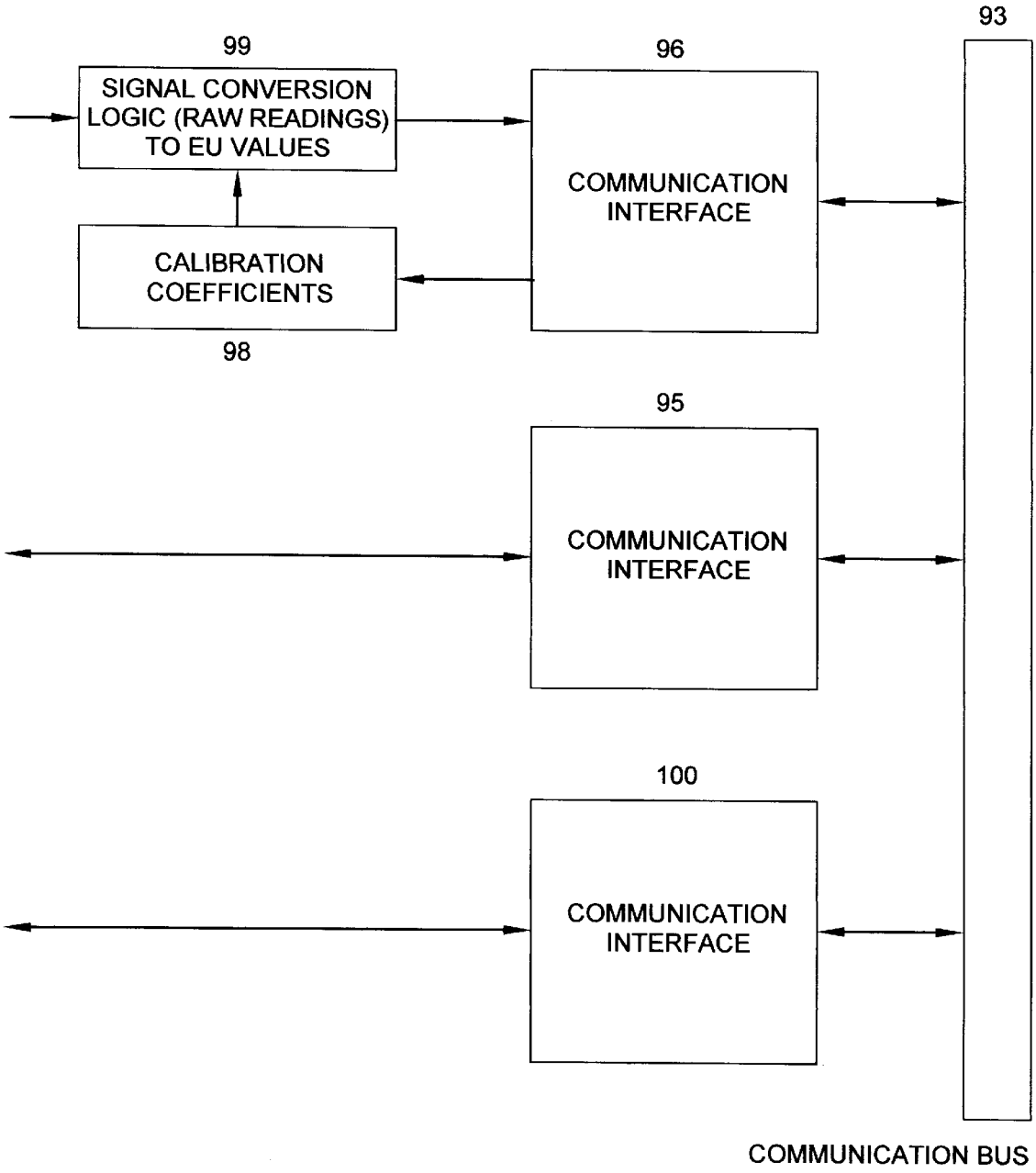

FIGS. 7, 7A and 7B show the software functions in the down hole tool which include three communications interfaces from the standard communication bus 93 of the micro-controller to; i) an interface 100 to a receiving modem 68 which is linked through the wireline cable 21 to the surface computer 85; ii) a communications interface 95 to the valve controller logic 94 which controls the switching device (output driver) 71 and thereby the actuator motor (valve) 34 and to the limit switches (position detection) 40; and iii) a communication interface 96 which takes raw signals from the pressure transducer 72 through the signal amplifier 69 and the analog to digital convertor 97 and uses calibration coefficients 98 to obtain engineering values 99.

The preferred procedures for obtaining optimum results with the repeated surge stimulation method are provided by the following description and by FIGS. 8*a–d* and FIGS. 9*a–d*. This description will disclose an inventive method for the removal of flow restricting (damaging) materials from the well bore surface and from the region around the well bore. It assumes that a stimulation tool such as previously disclosed has been lowered into a well with an oil bearing formation that has significant formation damage, very little inflow of oil into the well bore, and a very low fluid level in the well bore. It also assumes that the tool has been lowered on the end of a single coil tubing string and that the tool was pressure deployed into the well bore in order to maintain a low fluid level in the well bore.

Once the stimulation tool has been lowered to the desired depth in the well and all of the surface pumping and flow control equipment have been assembled and tested, stimulation operations can commence. Nitrogen is pumped into the coiled tubing at surface until the pressure in the tubing at the stimulation tool is approximately 800 psi above the pressure in the well bore at the tool. At that time, the stimulation engineer, who will be monitoring these pressures, will put the fluid control valve in the inflation position and allow the nitrogen to inflate the packers. After the packers have been fully inflated, the fluid control valve is closed, trapping pressure in the packers.

Figure 8A:
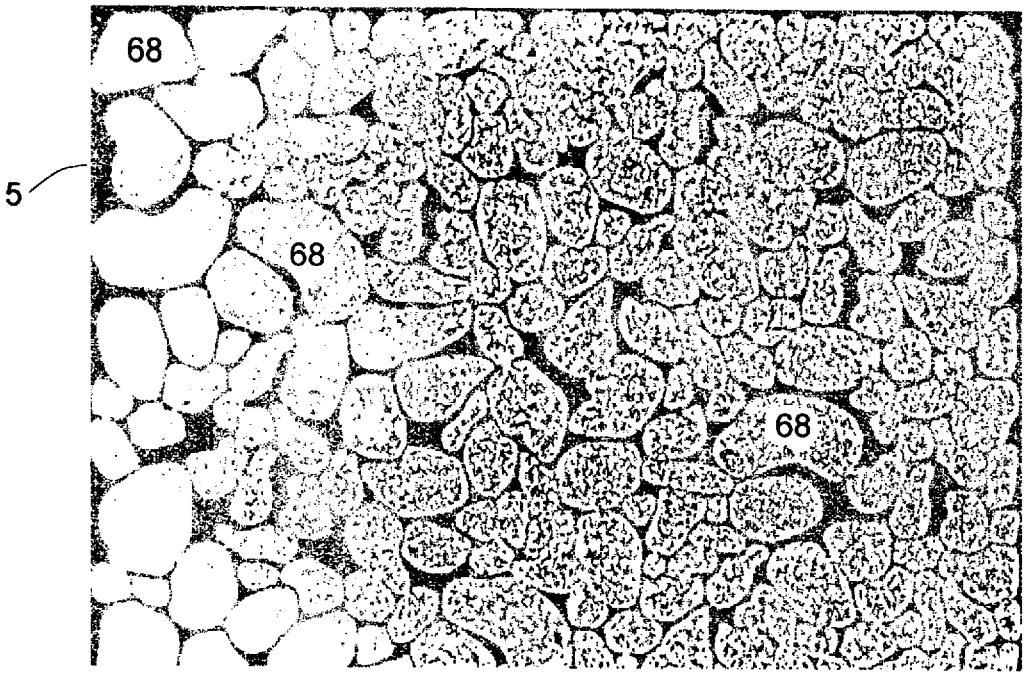
FIGS. 8*a*–*d* and FIGS. 9*a*–*d* are representations showing treatment of a formation according to the method steps.
Figure 8B:
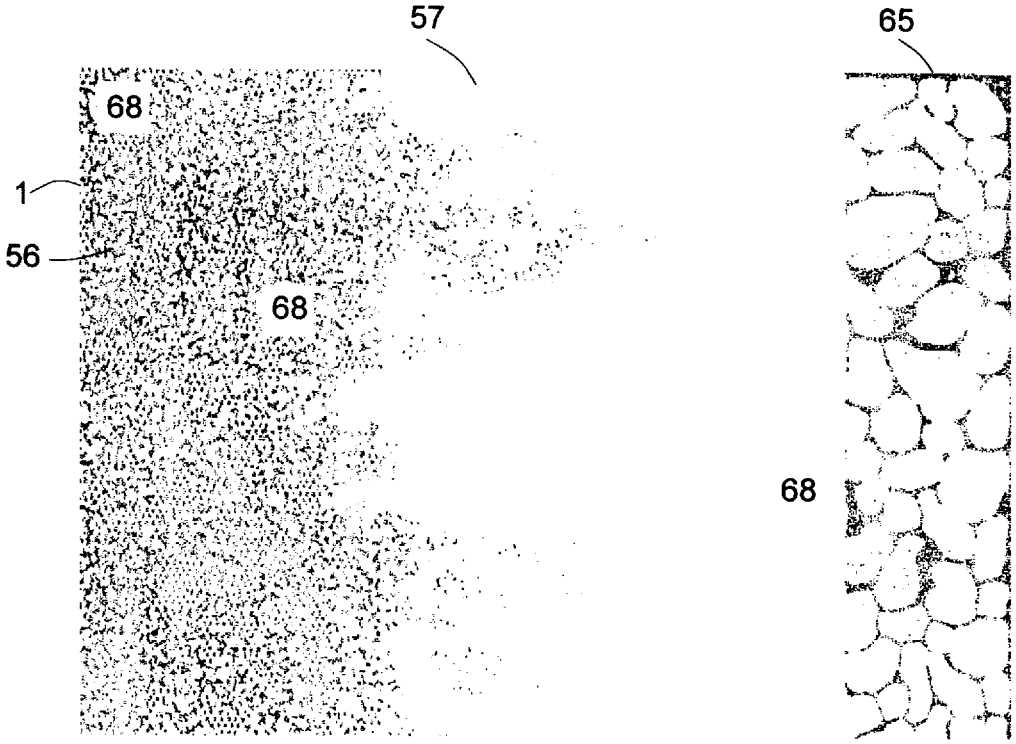

FIG. 8*a* shows a section of an oil bearing reservoir with formation particles 66 surrounded by reservoir fluids 65 which will typically include oil as well as some amounts of water and gases. FIG. 8*b* shows the formation with a well bore 1 drilled through it, along with formation damage from the drilling process, including a zone of solids invasion 56 and a zone of liquid invasion 57, which have displaced the oil 65 further back into the formation. It should be noted that for the purpose of simplicity, the damage shown in these figures is shown as very shallow damage and as homogeneous in each of the damage regions. In practice, the damage mechanism will be non-homogeneous and much more complex than shown.

After the packers have been inflated, the pressure in the tubing is increased to the selected initial stimulation pressure. This stimulation pressure will be based upon factors such as whether the formation is of sandstone or carbonate material, the formation pressure, the type of formation damage expected, the fluid in the formation and by experience in stimulating wells in each particular oil field. This initial stimulation pressure will generally be higher than the stabilized formation pressure by at least 500 psi.

Figure 8C:
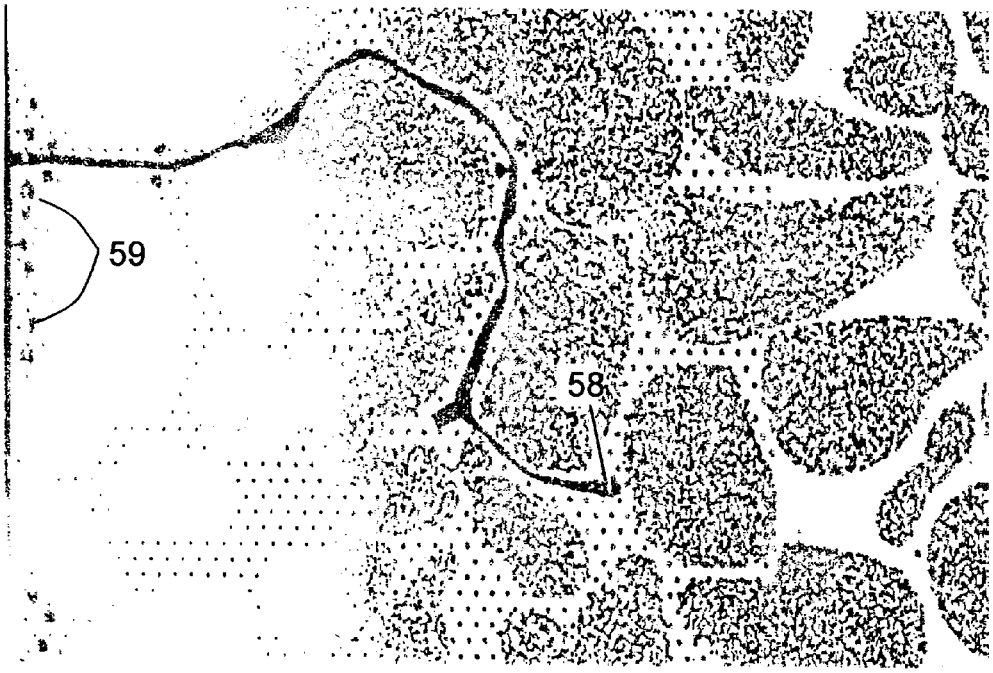

The fluid control valve is then moved to the injection position. Nitrogen is injected into the well bore region between the packers and begins to permeate the surface of the well bore into the formation as shown in FIG. 8*c*. Nitrogen gas molecules are significantly smaller than the molecules of liquid treating fluids such as hydrochloric acid, and will therefore penetrate pore spaces which are almost completely blocked by particles from drilling fluids or crushed drilling fines. Since the permeability to gas is much higher than the permeability to liquid for any formation, the gas will preferentially permeate into the formation leaving any well bore liquids in the well bore. The size of the gas molecules will allow it to migrate between the compacted particles from the drilling fluid and the drilling fines from the formation itself and create gas filled channels 58 and tiny pockets of gas 59.

After injecting nitrogen for a brief period of 15 seconds to several minutes, the fluid control valve is moved to the surge position. The flow of nitrogen from the tubing into the formation is shut off immediately and the pressure in the well bore between the packers is released back to the well bore above the top packer. Since the pressure in the annular region between the packers and in the formation is much higher than the pressure in the well bore above the top packer, a surge of fluids from between the packers takes place.

Figure 8D:
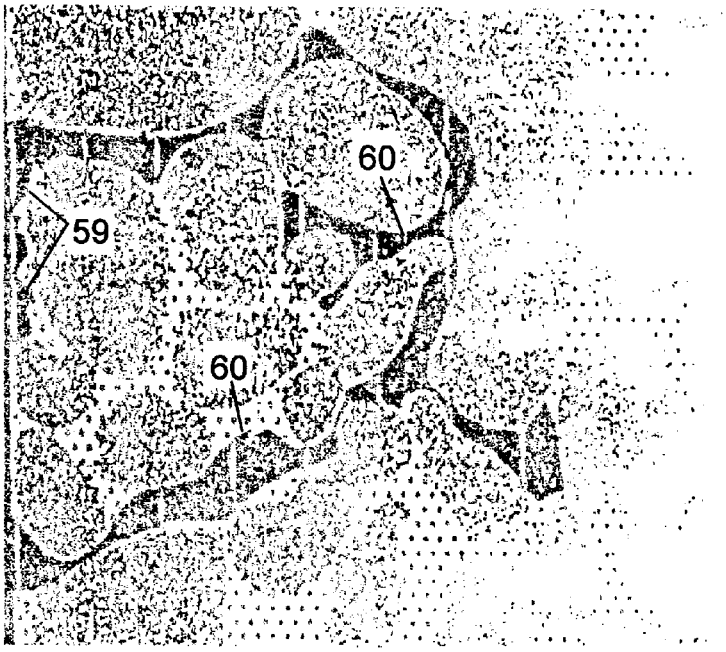

As the pressure between the packers is released, the pressurized nitrogen gas in that region will expand and force most of the liquid that remains there through the tool to the well bore above the top packer. FIG. 8*d* shows how this sudden decompression in the well bore region will cause a high pressure drop across the particles at the face of the well bore and the nitrogen in the tiny pockets 59 behind these particles will expand and force some of these particles into the well bore. The same thing happens along gas filled channels 58. The velocity of the gas flow along these channels will be relatively high and some of the particulate matter will be removed from the surface of these channels and forced out to the well bore as the channel widens. The pressure deeper in the gas filled channel will also result in new channels 60 opening up through pore spaces previously blocked with small particles.

Figure 9A:
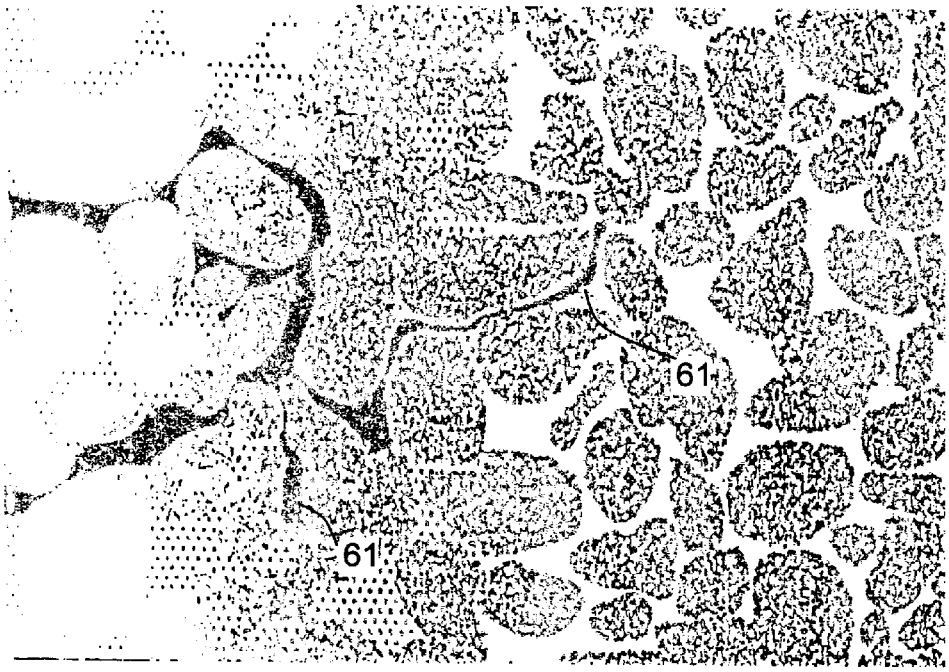
Figure 9B:
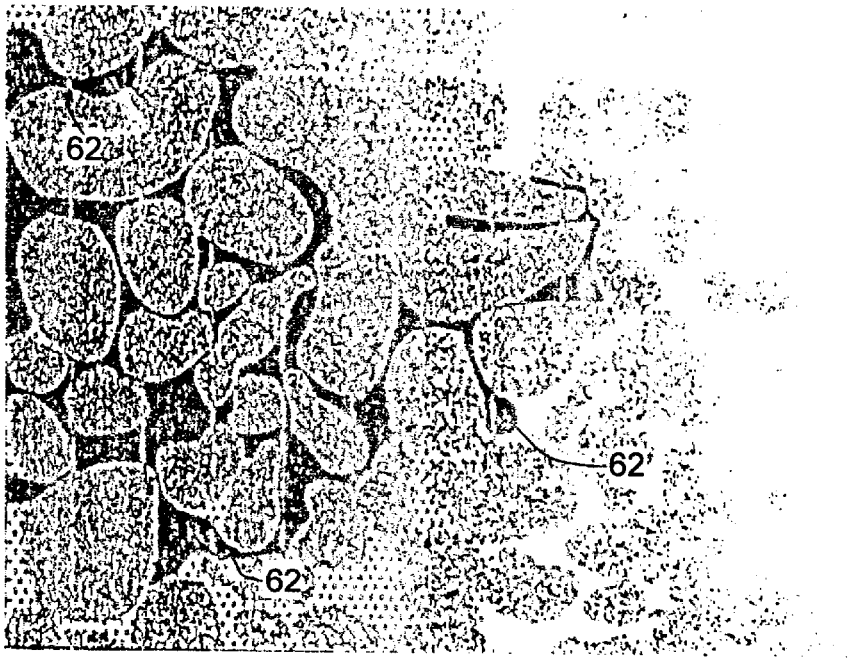

The fluid control valve is again placed in the injection position and nitrogen is injected into the formation a second time as shown by FIG. 9*a*. The duration of injection can remain constant or a longer injection period can be utilized to inject nitrogen further into the reservoir. The nitrogen will move further into the formation and extend previously opened gas filled channels even deeper as shown at 61. When the fluid control valve is moved to the surge position as in FIG. 9*b*, more damaging particles are removed and more channels 62 are cleared by nitrogen expanding and flowing back to the well bore.

Figure 9C:
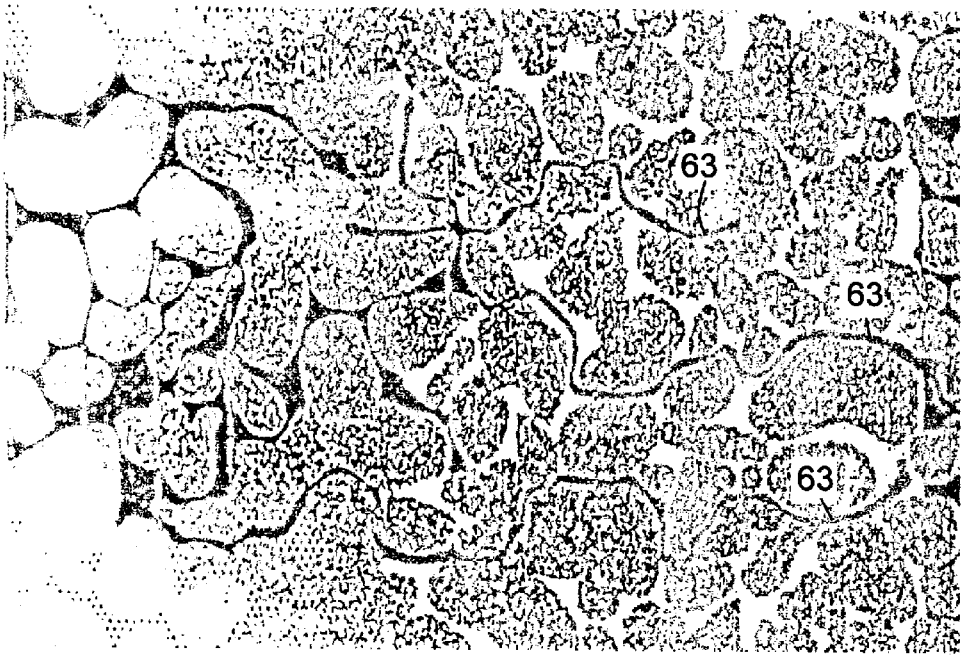
Figure 9D:
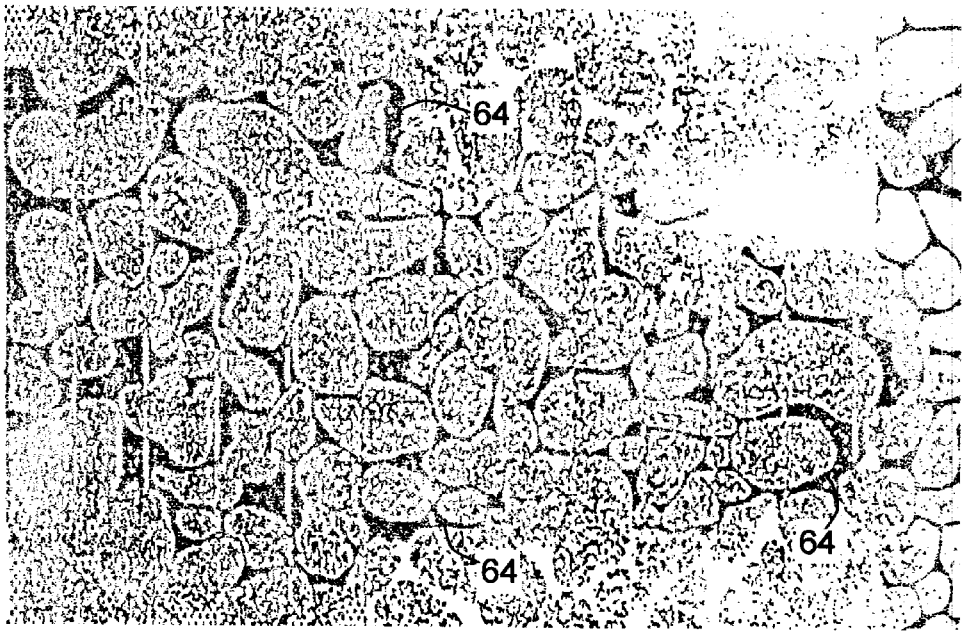

Subsequent injections cycles result in deeper penetration of nitrogen into the liquid invaded zone and all the way through to the oil zone as shown by channels 63 in FIG. 9*c*. Since nitrogen is soluble in liquids, some of the nitrogen will also be absorbed into liquid blockages such as emulsions or colloidal suspensions. When the pressure is released quickly during the following surge phase, the pressurized nitrogen will expand and force some of the blocking solids and liquids from the pore spaces into the gas filled channels and out to the well bore. Additional new channels 64 will be opened up for flow.

The desorption of liquids into the nitrogen gas may also allow for regained permeability in formations where clays and other minerals have absorbed liquids during the drilling or completion process and this absorption of liquids has resulted in swelling of these particles and a reduction in the permeability of the formation.

This injection and surge procedure can be repeated an unlimited number of times. The effectiveness of each cycle will be dependant upon the characteristics of each formation and the types of damage surrounding that particular well bore. The optimal pressure differential between injection pressure and release pressure may be different for differing types of formations. The stimulation pressure may be varied during each subsequent injection/surge sequence or held constant.

It should be realized that it is advantageous to control the pressure draw down in the formation during the surge cycle in order to prevent the reservoir fluid from flowing into the well bore region each time the pressure is released. By preventing liquid from refilling the pore spaces occupied by the nitrogen, the amount of nitrogen used will be minimized, surge time will be minimized and the effectiveness of the procedure will be improved since the well bore pressure will decline faster if no liquid must be forced through the tool with the nitrogen.

The pressure drawdown in the formation can be controlled by measuring the pressure in the well bore adjacent to the formation and using that pressure in the microprocessor within the tool to close the fluid control valve as soon as the well bore pressure declines to a specified set pressure, typically the static formation pressure.

After the final injection surge cycle, all of the nitrogen can be released back to the well bore above the packer, and oil will flow back through the formation to the well bore through the pore spaces which have been cleaned by the nitrogen surges. The fluid control valve can then be moved to the closed position.

The fluid control valve can then be moved to deflation position and the packers will be deflated. The tubing string can be coiled back onto the reel until the packers are at an unstimulated section of the well bore. This entire procedure can be repeated at as many intervals in the well bore as desired to effectively stimulate the well. It should be noted that prior to deflating the packers, with the fluid control valve in the closed position, the buildup up of reservoir pressure can be monitored and evaluated to determine the relative permeability of the formation and whether any formation damage remains in the well bore region.

Evaluation

Evaluation of porous formations before, during and after a stimulation treatment can be an important part of determining the effectiveness of any stimulation treatment. The permeability of the formation and the level of damage in the formation, determined prior to a stimulation treatment provides a base line against which later evaluations can be compared. A post treatment evaluation will then ascertain whether the treatment was successful, had no effect, or was detrimental.

Pressure transient analysis is a well developed science which utilizes the pressure measured during a formation response sequence. This sequence is created by withdrawing or injecting fluid into a porous formation for some period of time and then stopping the fluid flow and monitoring the pressure response to that fluid flow. This change in state from flowing to non-flowing creates a pressure transient in the well bore and in the formation that is a reflection of the characteristics of the formation.

A drill stem test is a commonly practised method of evaluating formations to determine the permeability and damage. After inflating the packers and evacuating the tubing string, a pre-stimulation drill stem test can be conducted by opening the fluid control valve to allow formation fluids to flow into the tubing string for a period of time and then closing the fluid control valve to monitor the pressure build up in the formation. Pressure transient analysis will allow the permeability and formation damage to be calculated. Prior to commencing injection of gas for the stimulation treatment, the fluid can then be purged from the tubing string into the well bore by pressurizing the tubing string with gas and opening the fluid control valve. A second drill stem test can be conducted at the conclusion of the stimulation treatment to evaluate the level of formation damage and stimulation effectiveness.

A second method for the evaluation of stimulation effectiveness involves monitoring of pressures as fluid (usually acid) is injected at a constant rate. As damage is removed from the formation by acid, the injection pressure declines. This technique is relatively new and requires pressure monitoring equipment, such as provided by the present invention, to be in place in order to be utilized effectively.

The present invention introduces the use of real time evaluation of stimulation effectiveness through continuous monitoring of pressure within the tubing string, within the well bore in the region isolated for treatment, within the well bore above the packer(s), and the pressure within the packers. These pressure monitoring and analysis capabilities allow new evaluation methods to be developed and utilized. For example, a closed chamber injection method can be employed whereby the tubing string is pressurized with gas to the same pressure prior to the start of each injection cycle and no additional gas is added to the tubing string during that injection cycle. This initial pressure must be significantly higher (greater than 20%) than the static formation pressure. If the injection time for each cycle is exactly the same, then monitoring and evaluating the tubing pressure and well bore pressure during each cycle may be an indicator of the stimulation effectiveness.

Major Advantages of The Preferred Embodiment For Repeated Surge Stimulation Technique The use of a single string coiled tubing string for deployment of the down hole apparatus into a well bore which is not overbalanced in pressure is advantageous compared to the use of other tubular arrangements for several reasons.

The development of an electrically operable multi-position fluid control valve for use in the preferred embodiment provides the following advantages:

1. It simplifies the down hole tool design which minimizes the length of tool. This is especially critical for pressure deployment of the tools into live wells. It is also important in treating horizontal wells with a short horizontal bend radius, since it reduces the length of the relatively inflexible portion of the tool.
2. It simplifies the electronics design from both hardware design and software design viewpoints. This in turn improves the reliability of the control system.
3. It allows all valve operations to be performed independent of the pressure in any tubing string or in the well bore.
4. It allows all valve operations to be performed independent of tensile or compressive forces in any of the tubing strings.
5. It allows fluid to be pumped into the well bore below the top packer independent of whether the packers are inflated or not.
6. It provides a means of circulating fluids down the tubing and up the well bore when a build up of solids or any particulate matter is preventing the tubing or tool from being withdrawn from the well bore.

A major advantage of the repeated surge stimulation technique is that the amount of nitrogen utilized can be very closely controlled and can be minimized since the nitrogen in the injection string never needs to be vented back to surface, except at the end of operations.

Nitrogen gas molecules are significantly smaller than the molecules of liquid treating fluids such as hydrochloric acid, and will therefore penetrate pore spaces which are almost completely blocked by particles from drilling fluids or crushed drilling fines.

Other Embodiments of the Present Invention

The preceding disclosure of the preferred embodiment is only one of a number of embodiments which are envisioned for this invention.

The use of a normal jointed tubular string in conjunction with wireline spooled from a conventional wireline logging unit would provide the same capabilities as the preferred embodiment. However, jointed tubing is more complex operationally because it takes longer to run jointed tubing into a well, and wireline must be inserted and withdrawn in order to remove joints of tubing each time the packer(s) are moved to a different setting depth.

The use of concentric coiled tubing allows the tools to be deployed in a well either filled with liquid or with a very high fluid level. Concentric tubing uses the annular area between the two coils to inject fluids into the well bore and the inner coil to return fluids from the formation. This embodiment has the added advantage that produced fluids could be circulated from the tubing by allowing nitrogen gas from the outer tubing to flow into the inner tubing. However, this embodiment is more complex to assemble and operate and has significant limitations in well depth as a result of the extreme weight of the assembled concentric coiled tubing reel and normal weight restrictions imposed on highways.

Both singular packer and multiple packer embodiments are anticipated with the present invention. Single packer assemblies allow the well bore to be divided into two regions, one above the packer and one below the packer, with evaluation and stimulation of only the region below the packer. There are very few situations where a single packer assembly would be advantageous over a dual packer assembly and many advantages to the dual packer arrangement. It is also envisioned that multiple packer arrangements be utilized in order to allow two or more discreet intervals to be evaluated and or stimulated simultaneously.

A preferred embodiment discloses the use of a single multi-position fluid control valve as an optimal valve arrangement to simplify the design of the tool and provide maximum reliability. However, the method of the present invention can also be effective if multiple electrically operated valves or any other type or combination of valves is used to provide fluid control functions.

A preferred embodiment previously disclosed utilizes pressure created by fluids injected into the formation from the tubing string to provide the energy to remove formation damaging materials from the pore spaces in the formation. The use of the natural energy within the formation can also be utilized to create a surge of fluid flow into the well bore and the tubing string. The apparatus disclosed in the present invention allows a method of surging whereby the packers are first inflated with gases from the tubing string, after which the tubing pressure is vented back to surface. The tubing string must be utilized to receive the surge of fluids, since the well bore pressure above the packer(s) will be either equal to or greater than the formation pressure and will not allow fluids and pressure to flow from the formation.

The fluid control valve is then opened to allow the natural energy from the formation to flow into the tubing string briefly, then closed until the formation pressure in the well bore and near well bore area is replenished from the formation. This would typically mean allowing the pressure in the well bore to reach at least 70% of the actual formation pressure. The fluid control valve can be opened again for another surge, and then shut in. This procedure can be repeated as required until sufficient formation damaging material has been removed. This embodiment works particularly well for gas wells or wells with relatively low liquid inflow since the gas pressure in the tubing string can be vented at surface to maintain a relatively low pressure in the tubing string down hole and a high pressure surge differential when the valve is opened. If significant liquid inflow results in low surge capability, the liquid can be purged from the tubing string by deflating the packers, opening the fluid control and pumping gas into the tubing string with sufficient pressure to displace the liquid into the well bore. Additional surging of the same or another interval can then be carried out.

I claim:

1. A method of treating an underground formation that has been penetrated by a well, the well having a wellbore, the method comprising the steps of:

lowering a valve assembly into the well until the valve assembly is adjacent the underground formation with the valve assembly being placed to control flow of fluid between the underground formation and the wellbore;

providing a source of pressurized treatment fluid in fluid communication with the valve assembly;

establishing a pressure differential across the valve assembly;

selectively and repeatedly opening and closing ports in the valve assembly to cause pressure variation in the underground formation and induce surges of fluid from the underground formation into the wellbore; and injecting treatment fluid from the source of pressurized treatment fluid into the underground formation to increase the pressure in the underground formation prior to each surge of fluid from the underground formation.

2. The method of claim 1 in which the pressure of the underground formation rises above an initial formation pressure while injecting treatment fluid and drops below initial formation pressure during surge of fluid from the underground formation.

3. The method of claim 2 in which treatment fluid is injected into the underground formation through a first flow channel extending from the surface and fluid from the underground formation is returned towards the surface through a second flow channel distinct from the first flow channel.

4. The method of claim 3 in which the valve assembly has multiple ports, including at least a first port for controlling flow in the first flow channel and a second port for controlling flow in the second flow channel.

5. The method of claim 3 in which the first flow channel is formed by the interior of a first string of tubing and the second flow channel is formed by an annulus between the first string of tubing and a second string of tubing.

6. The method of claim 1 further comprising the step of isolating the underground formation prior to inducing pressure surges in the underground formation.

7. The method of claim 6 in which the underground formation is isolated by inflating a first packer above the underground formation to be treated.

8. The method of claim 7 in which inflating the first packer comprises injecting fluid into the first packer under control of the valve assembly.

9. The method of claim 7 further comprising the step of inflating a second packer below the underground formation to be treated.

10. The method of claim 1 further comprising the step of monitoring pressure variation in the underground formation during treatment of the underground formation.

11. The method of claim 10 further comprising the step of terminating release of pressure from the underground formation when the underground formation pressure reaches a pre-set pressure.

12. The method of claim 11 in which the pre-set pressure is the underground formation pressure prior to injection of fluid into the underground formation.

13. The method of claim 1 further comprising the step of monitoring pressure variation in the wellbore during treatment of the underground formation.

14. The method of claim 3 further comprising the step of monitoring pressure variation in the first flow channel during treatment of the underground formation.

15. The method of claim 1 in which the treatment fluid injected into the underground formation is nitrogen.

16. The method of claim 1 in which injection of treatment fluid and surging of fluid from the underground formation is repeated one or more times.

17. The method of claim 1 in which the method steps are repeated to remove solid materials from the underground formation.

18. The method of claim 17 in which tie solid materials are selected from the group consisting of formation cuttings, formation fines, sand, drilling fluid suspended solids, drilling fluid filter cake, sediments and precipitates from the well bore and pore spaces in the underground formation.

19. The method of claim 1 in which the method steps arc repeated to remove fluids from the underground formation, wherein the fluids are selected from the group consisting of liquids, emulsions, colloidal suspensions and multi-phase fluids.

20. The method of claim 1 in which lowering a valve assembly into the well comprises lowering into the well a multiport valve operable by an electric motor.

21. The method of claim 20 further comprising controlling fluid flow in the well by opening and closing ports in the multiport valve under instruction from the surface to the electric motor.

22. The method of claim 20 in which the multiport valve is suspended on the end of a tubing string and further comprising the step of injecting fluid through a first flow channel to the multiport valve to force fluid in the wellbore towards the surface.

23. The method of claim 22 in which the valve assembly is provided with at least one packer suspended on the tubing string below the valve assembly and control of fluid is carried out while the packer is not inflated.

24. The method of claim 1 further comprising the step of:

providing a tubular arrangement for installation in the well bore, the tubular arrangement comprising a first channel and a second channel distinct from the first channel for segregated fluid flow;

the first channel providing a flow path from pumping equipment at surface to the valve assembly; and the second channel providing fluid flow from the valve assembly to flow control equipment at surface.

25. The method of claim 24 in which the valve assembly is attached as part of a downhole tool assembly to the distal end of the tubular arrangement for lowering into the well bore to the desired depth.

26. The method of claim 25 further comprising the step of:

isolating the underground formation by isolating at least one linear segment of the well bore from the remainder of the well bore by the use of at least one well bore sealing element, the well bore sealing element forming part of the downhole tool assembly.

27. The method of claim 26 in which selectively and repeatedly opening and closing the valve assembly comprises the steps of:

filling the first channel with fluid and opening a port in the down hole assembly to allow the fluid in the first channel to flow into the underground formation;

closing the port in the down hole assembly; and opening a port in the down hole assembly to allow the fluids injected into the underground formation, as well as fluids and solid materials from the underground formation to flow back into the second channel.

28. The method of claim 27 in which a first sealing element above the underground formation and a second sealing element below the underground formation are used to isolate the underground formation.

29. The method of claim 27 in which multiple segments of the well bore are isolated using multiple sealing elements.

30. The method of claim 1 in which plural underground formations are treated simultaneously.

31. The method of claim 27 where the first channel is formed within a continuous string of coiled tubing, and the second channel is formed in an annular area around the string of coiled tubing.

32. The method of claim 31 in which the downhole tool assembly is suspended on the end of the string of coiled tubing.

33. The method of claim 27 where the first channel is formed within a string of jointed tubing or drill pipe and the second fluid channel is formed in an annular area around the jointed tubing or drill pipe.

34. The method of claim 33 in which the downhole tool assembly is suspended on the end of the jointed tubing or drill pipe.

35. The method of claim 27 in which the downhole tool assembly is suspended on a concentric coil-in-coil tubing string, the concentric coil-in-coil tubing string being formed of a first string of coiled tubing located axially inside a second string of coiled tubing.

36. The method of claim 35 in which the first channel is formed by a selected one of the first string of coiled tubing and the second string of coiled tubing, and the second channel is formed by an annular area around the second string of coiled tubing.

37. The method of claim 35 in which the first channel is formed by a selected one of the first string of coiled tubing and the second string of coiled tubing, and the second channel is formed by the other of the first string of coiled tubing and the second string of coiled tubing.

38. The method of claim 27 in which the down hole assembly is lowered on the end of a string of jointed tubulars and a string of coiled tubing is then inserted axially inside the jointed tubulars and sealed from the jointed tubulars, one of the jointed tubulars and the string of coiled tubing forming the first channel.

39. The method of claim 27 in which the down hole assembly is lowered on the end of a string of jointed tubulars and a string of coiled tubing is then inserted axially inside the jointed tubulars and sealed from the jointed tubulars, one of the jointed tubulars and the string of coiled tubing forming the first channel and the other of the jointed tubulars and the string of coiled tubing forming the second channel.

40. The method of claim 29 where the second channel is formed by an annular area around the string of jointed tubulars.

41. The method of claim 27 in which first and second strings of coiled tubing are located axially beside each other in the well and the first and second swings of coiled tubing are used to deliver the down hole assembly, and the fluid channels in each of the first and second strings of coiled tubing are segregated from the other such that one string of coiled tubing forms the first channel.

42. The method of claim 27 in which first and second strings of coiled tubing are located axially beside each other in the well and the first and second strings of coiled tubing are used to deliver the down hole assembly, and the fluid channels in each of the first and second strings of coiled tubing are segregated from the other such that one string of coiled tubing forms the first channel and the other string of coiled tubing forms the second channel.

43. The method of claim 42 in which the second channel is formed by an annular area around the first and second strings of coiled tubing.

44. The method of claim 27 in which the at least one well bore sealing element is inflatable in nature and is expandable by the use of a valve arrangement in the down hole assembly to allow pressure from the first channel to flow into the sealing elements.

45. The method of claim 44 where a packer vent valve in the down hole assembly for allowing pressure and fluid from the at least one well bore sealing element to be vented to the second channel to deflate the at least one well bore sealing element.

46. The method of claim 27 where the pressure at the down hole assembly in the first channel, prior to opening the port to allow fluid to flow into the underground formation, is higher than the pressure in the underground formation.

47. The method of claim 27 the second channel is initially void of fluids prior to causing pressure variation in the underground formation.

48. The method of claim 27 where the pressure at the down hole assembly in the second channel is less than the underground formation pressure.

49. The method of claim 27 in which the fluid injected into the reservoir is in a liquid state.

50. The method of claim 27 in which the fluid injected into the reservoir is in a gaseous state.

51. The method of claim 27 in which the fluid injected into the reservoir is a two phase mixture of fluids in a gaseous and liquid state.

52. The method of claim 27 in which the injected fluid is alternated between a liquid phase for one injection cycle and a gas for a subsequent injection cycle.

53. The method of claim 1 in which the valve assembly is lowered into the well bore on a tubing string.

54. The method of claim 27 in which the valve assembly is operated independently of any mechanical movement of the tubing string and independently of any pressure in the tubing string or well bore.

55. The method of claim 54 in which the valve assembly is operated using computer software to initiate a command in a computer or microprocessor or micro controller which is located at the surface of the well location.

56. The method of claim 55 further comprising operating the valve assembly by having the surface computer send the command to a second microprocessor or micro controller located in the down hole assembly.

57. The method of claim 56 further comprising the step of using the down hole microprocessor or micro controller to sense or determine the position of the valve assembly.

58. The method of claim 57 further comprising the step of using an electrically operated valve control motor to provide the mechanical force necessary to move the valve assembly from one position to another position.

59. The method of claim 58 further comprising the step of using the down hole microprocessor or micro controller to switch electrical power in the appropriate polarity to the electrically operated valve control motor.

60. The method of claim 59 further comprising the step of using the down hole microprocessor or micro controller to sense when the valve assembly has reached the required position.

61. The method of claim 60 further comprising the step of using the down hole microprocessor or micro controller to switch off the electrical power to the electrically operated valve control motor.

62. The method of claim 61 where a third computer located remotely from the well location is connected by a wireless communications network to the computer at the well location and the command to operate the fluid control valve is given from the remotely operated computer.

63. The method of claim 58 further comprising the step of:

measuring pressure in one or more of the locations within the downhole tool assembly and well bore which might at any time during well evaluation or treating operations be different from the pressure at any other location within the tool or well bore to produce pressure sensing data;

automatically switching electrical power to the electrically operated valve control motor using the down hole microprocessor or micro controller in response to the pressure sensing data to move the valve assembly to a specified operating position based upon preset criteria for the pressure sensing data;

using the down hole microprocessor or micro controller to sense when the valve assembly has reached the specified operating position; and using the down hole microprocessor or micro controller to switch off the electrical power to the electrically operated valve control motor.

64. The method of claim 63 in which the one or more pressures measured are selected from the group consisting of pressure in one or more tubing strings, pressure in one or more inflatable packers, pressure in the well bore above a top packer and pressure in the well bore below a top packer.

65. The method of claim 1 in which the valve assembly is lowered into the well bore as part of a downhole tool assembly suspended on a coiled tubing string.

66. The method of claim 65 in which valve assembly is a multi-position fluid control valve and the downhole tool assembly comprises inflatable well bore sealing means, a micro-controller, pressure sensing devices, and a communication modem.

67. A method of formation evaluation comprising treating a well according to the method of claim 66 and further comprising subsequently performing the steps of:

pressurizing the coiled tubing to a first pressure at the down hole assembly which is greater than a second pressure in the well bore at the down hole assembly, said first and second pressures being monitored by the pressure sensing devices;

opening the multi-position fluid control valve in the down hole assembly to allow fluid in the coiled tubing to flow into the inflatable well bore sealing means thereby isolating at least one linear segment of the well bore from the remainder of the well bore;

closing the multi-position fluid control valve in the down hole assembly;

reducing the first pressure to below the second pressure which monitoring the first pressure and the second pressure with the pressure sensing devices in the down hole assembly;

opening the multi-position fluid control valve in the down bole assembly to allow fluids in the at least one isolated linear segment of the well bore, as well as fluids and solid materials from the underground formation adjacent to the at least one linear segment of the well bore, to flow through the multi-position fluid control valve;

closing the multi-position fluid control valve in the down bole assembly and recording the pressure response in the at least one isolated linear segment of the well bore using pressure sensing devices in the down hole assembly; and opening the multi-position fluid control valve in the down hole assembly to allow the fluids in the inflatable well bore sealing means to flow into the well bore until the pressure has been equalized and the inflatable well bore sealing means have deflated.

68. The method of claim 67 in which the fluids and solid materials from the underground formation adjacent to the at least one linear segment of the well bore flow trough the multi-position fluid control valve into an annular region above the multi-position fluid control valve.

69. The method of claim 67 further comprising completing one or more steps selected from the group consisting of causing more than one period of inflow into the coiled tubing string and more than one period of monitoring pressure build up in the well bore.

70. The method of claim 67 in which the fluid used to pressurize the coiled tubing string is a gas.

71. The method of claim 70 in which the fluid used to pressurize the coiled tubing string is a mixture of liquid and gas such that the amount of liquid does not create a hydrostatic pressure in the coiled tubing string greater than the pressure in the underground formation adjacent to the down hole assembly.

72. A method of treating an underground formation that has been penetrated by a well and that has an initial formation pressure, the well having a wellbore, the method comprising the steps of:

lowering a valve assembly with multiple ports into the well until the valve is adjacent the underground formation with the valve assembly being placed to control flow of fluid between the underground formation and the wellbore;

isolating the underground formation from the well bore above the underground formation;

establishing a pressure differential across the valve assembly; and causing formation pressure variation by selectively and repeatedly opening and closing the valve assembly to induce surges of fluid from the underground formation into the wellbore, the formation pressure rising above and below the initial formation pressure during the formation pressure variation.

73. The method of claim 72 in which treatment fluid is injected into the underground formation through a first flow channel extending from the surface and fluid from the underground formation is returned towards the surface through a second flow channel distinct from the first flow channel.

74. The method of claim 72 further comprising the step of isolating the underground formation prior to inducing pressure surges in the underground formation.

75. The method of claim 74 in which isolating the underground formation comprises the step of inflating a first packer above the underground formation to be treated.

76. The method of claim 75 further comprising the steps of:

providing a source of pressurized treatment fluid in fluid communication with the valve assembly; and injecting treatment fluid form the source of pressurized treatment fluid into the underground formation to increase the pressure in the underground formation above the underground formation pressure prior to each surge of fluid from the underground formation.

77. The method of claim 76 in which isolating the underground formation further comprises inflating a second packer below the underground formation to be treated.

78. The method of claim 77 in which inflating the first packer and the second packer comprises injecting fluid from the first flow channel into the first packer and the second packer under control of the valve assembly.

79. The method of claim 78 in which the valve assembly has at least a first port for controlling flow in the first flow channel and a second port for controlling flow in the second flow channel.

80. The method of claim 79 in which the first flow channel is formed by the interior of a first sting of tubing and the second flow channel is formed by an annulus between the first string of tubing and a second string of tubing.

81. The method of claim 72 further comprising the step of monitoring pressure variation in the underground formation during treatment of the underground formation.

82. The method of claim 81 further comprising the step of terminating release of pressure from the underground formation when the underground formation pressure reaches a pre-set pressure.

83. The method of claim 82 in which the pre-set pressure is the underground formation pressure.

84. The method of claim 72 further comprising the step of monitoring pressure variation in the wellbore during treatment of the underground formation.

85. The method of claim 73 further comprising the step of monitoring pressure variation in the first flow channel during treatment of the underground formation.

86. The method of claim 73 in which the treatment fluid injected into the underground formation is nitrogen.

87. The method of claim 72 in which, between surges, the formation pressure is allowed to build up naturally, without injection of fluid from the surface.

* * * * *